US008021816B2

(12) United States Patent
Teshima

(10) Patent No.: US 8,021,816 B2
(45) Date of Patent: Sep. 20, 2011

(54) LIQUID DEVELOPER AND IMAGE FORMING APPARATUS

(75) Inventor: Takashi Teshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 496 days.

(21) Appl. No.: 12/262,828

(22) Filed: Oct. 31, 2008

(65) Prior Publication Data

US 2009/0123188 A1 May 14, 2009

(30) Foreign Application Priority Data

Nov. 13, 2007 (JP) ..... 2007-294834

(51) Int. Cl.
*G03G 9/135* (2006.01)

(52) U.S. Cl. ..... 430/115; 430/114

(58) Field of Classification Search ..... 430/115, 430/114
See application file for complete search history.

(56) References Cited

FOREIGN PATENT DOCUMENTS

JP 2002-214849 7/2002

OTHER PUBLICATIONS

Machine English language translation of JP2901013, Jun. 2, 1999.*

* cited by examiner

*Primary Examiner* — Hoa Le
(74) *Attorney, Agent, or Firm* — DLA Piper LLP (US)

(57) ABSTRACT

A liquid developer includes: an insulating liquid; toner particles constituted by a resin material as a main component; and a dispersing agent expressed by Formula (I):

$$H_2N—R—NH—R' \quad (I)$$

(where, R denotes an alkylene group having a carbon number of 2 to 6 and R' denotes an alkyl group having a carbon number of 8 to 24).

8 Claims, 4 Drawing Sheets

LIQUID DEVELOPER AND IMAGE FORMING APPARATUS

BACKGROUND

1. Technical Field

The present invention relates to a liquid developer and an image forming apparatus.

2. Related Art

As a developer used for developing an electrostatic latent image formed on a latent image carrier, a liquid developer in which a toner formed of a material including a coloring agent such as pigment and binder resin is dispersed in an insulating carrier liquid (insulating liquid) is known.

The liquid developer includes a negative charge type liquid developer and a positive charge type liquid developer. If the negative charge type liquid developer is used, ozone occurs in an image forming apparatus when an image is formed and has an adverse influence on peripheral parts of the image forming apparatus or an environment.

Accordingly, recently, in order to form an image while reducing the production amount of discharge product such as ozoner a method of forming an image using a positive charge type liquid developer has been developed (for example, see JP-A-2002-214849).

In the positive charge type liquid developer described in JP-A-2002-214849, a charge control agent is added such that a toner particle is positively charged.

From the viewpoint of fixability or charge characteristics, a negative charge type material is widely used as a resin material configuring the toner particle. However, if the negative charge type resin material is used, it is difficult to positively charge the toner particle (liquid developer). The toner particle using the negative charge type resin material may be positively charged by adding the charge control agent, but, in this case, it is difficult to obtain a sufficient charge amount.

The positive charge type resin material may be used as the material configuring the toner particle. However, since the positive charge type resin material has low stability, it is difficult to use the positive charge type resin material as a material configuring the toner particle.

SUMMARY

An advantage of some aspects of the invention is that it provides a liquid developer having excellent positive charge characteristics and dispersion stability of a toner particle and also an image forming apparatus using the liquid developer.

According to an aspect of the invention, there is provided a liquid developer including: an insulating liquid; toner particles constituted by a resin material as a main component; and a dispersing agent expressed by Formula (I):

$$H_2N—R—NH—R' \quad (I)$$

(where, R denotes an alkylene group having a carbon number of 2 to 6 and R' denotes an alkyl group having a carbon number of 8 to 24).

In the liquid developer according to the aspect of the invention, the content of the dispersing agent is preferably 1 to 10 parts by weight with respect to 100 parts by weight of the toner particles.

In the liquid developer according to the aspect of the invention, the insulating liquid preferably includes monoester fatty acid.

In the liquid developer according to the aspect of the invention, the content of the monoester fatty acid in the insulating liquid is preferably 1 to 50 wt %.

In the liquid developer according to the aspect of the invention, the resin material preferably has an ester bond.

In the liquid developer according to the aspect of the invention, the acid value of the resin material is preferably 5 to 20 mgKOH/g.

In the liquid developer according to the aspect of the invention, the liquid developer may be manufactured by manufacturing a dispersion liquid in which a dispersoid including the resin material is dispersed in an aqueous dispersion medium; compounding a plurality of dispersoids and obtaining compounded particles; removing an organic solvent included in the compounded particles and obtaining toner particles; and dispersing the toner particles and the dispersing agent in the insulating liquid.

According to another aspect of the invention, there is provided an image forming apparatus including: a plurality of development portions forming single-color images of colors using a plurality of liquid developers having different colors; an intermediate transferring portion sequentially transferring the plurality of single-color images formed on the plurality of development portions and forming an intermediate transfer image obtained by overlapping the plurality of transferred single-color images; a secondary transferring portion transferring the intermediate transfer image on a recording medium and forming an unfixed color image on the recording medium; and a fixing portion fixing the unfixed color image on the recording medium, wherein the liquid developer includes an insulating liquid; toner particles constituted by a resin material as a main component; and a dispersing agent expressed by Formula (I):

$$H_2N—R—NH—R' \quad (I)$$

(where, R denotes an alkylene group having a carbon number of 2 to 6 and R' denotes an alkyl group having a carbon number of 8 to 24).

By the above-described configuration, it is possible to provide a liquid developer which is excellent in the charge characteristics of the positive charge and the dispersion stability of the toner particles and an image forming apparatus using the liquid developer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
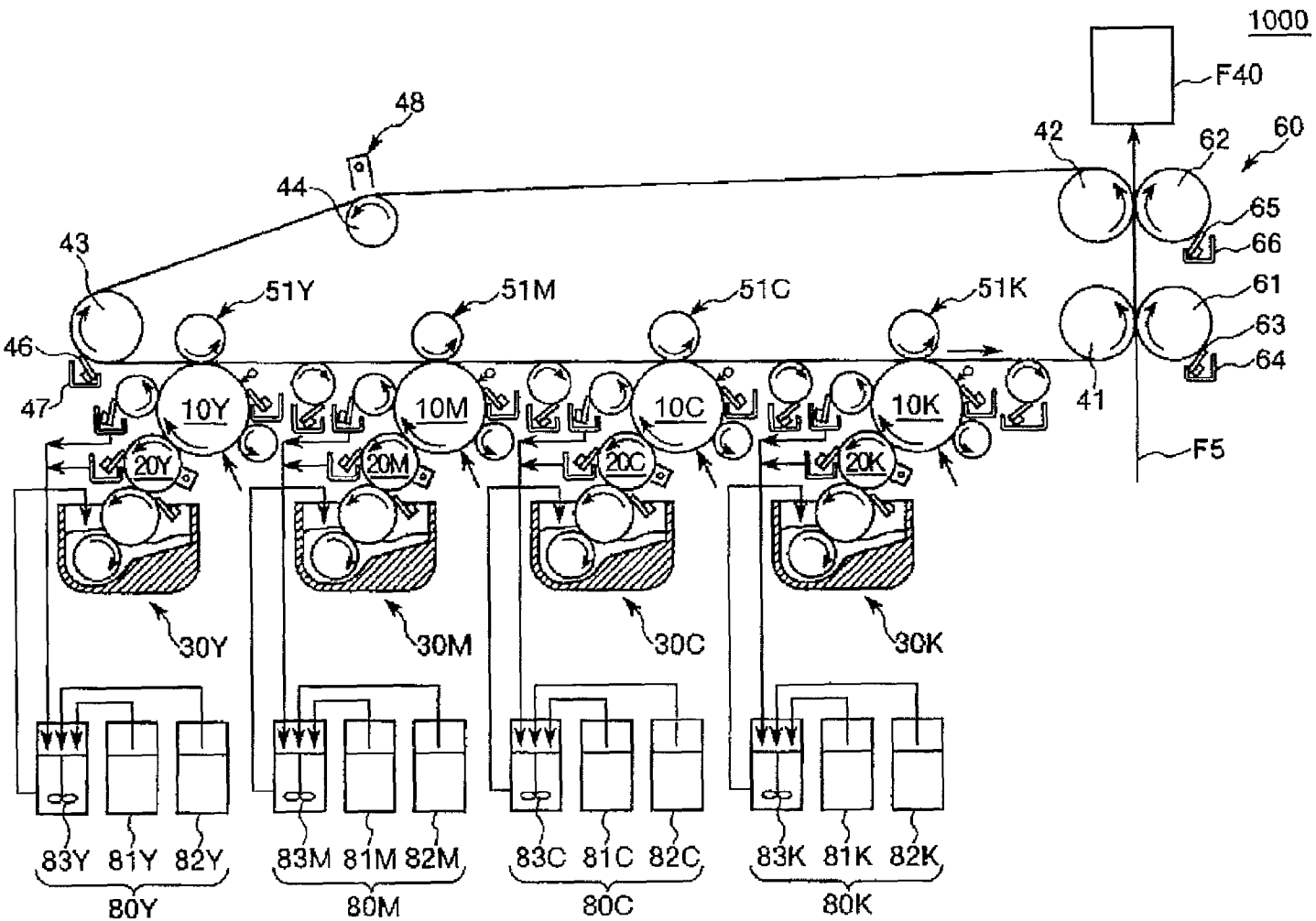
FIG. 1 is a view showing an example of an image forming apparatus using a liquid developer according to an embodiment of the invention.

Hereinafter, the embodiments of the invention will be described in detail.

Liquid developer

First, a liquid developer according to an embodiment of the invention will be described. In the liquid developer according to the embodiment of the invention, toner particles are dispersed in an insulating liquid. The liquid developer according to the embodiment of the invention includes a dispersing agent having a predetermined structure.

Dispersing Agent

First, the dispersing agent will be described.

The liquid developer according to the embodiment of the invention includes the dispersing agent expressed by the following Formula (I):

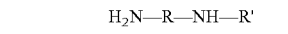

$$H_2N—R—NH—R' \quad (I)$$

(where, R denotes an alkylene group having a carbon number of 2 to 6 and R' denotes an alkyl group having a carbon number of 3 to 24).

From the viewpoint of fixability or charge characteristics, a negative charge type material is widely used as a resin material configuring the toner particle. However, if the negative charge type resin material is used, it is difficult to positively charge the toner particle (liquid developer). The toner particle using the negative charge type resin material may be positively charged by adding the charge control agent, but, in this case, it is difficult to obtain a sufficient charge amount. The positive charge type resin material may be used as the material configuring the toner particle. However, since the positive charge type resin material has low stability, it is difficult to use the positive charge type resin material as a material configuring the toner particle.

In contrast, if the dispersing agent having the above-described structure is used, the following effects can be obtained.

A resin material configuring the toner particles generally has an acid group (carboxyl group or the like) in the molecule thereof. This acid group and primary amine moiety ($NH_2$—) of the dispersing agent are bonded by an ionic bond and the dispersing agent is chemically attached or absorbed to the surfaces of the toner particles. Secondary amine moiety (—NHR') of the dispersing agent particularly has high compatibility with an insulating liquid (in particular, hydrocarbon liquid or fatty acid ester) as described later and thus is arranged so as to face the insulating liquid. Since the dispersing agent is absorbed to the surfaces of the toner particles in this state, the dispersing agent is interposed between the adjacent toner particles with certainty, the coagulation of the toner particles is efficiently prevented, and the dispersibility of the toner particles is excellent.

Since a nitrogen atom of the secondary amine moiety (—NHR') of the dispersing agent attracts proton ($H^+$) released from the acid group of the resin material, it is possible to positively charge the toner particles. Accordingly, the charge characteristics of the positive charge of the liquid developer are excellent. Due to the excellent charge characteristics, development efficiency and transfer efficiency are also excellent.

In the below-described image forming apparatus, when the liquid developer recovered from a development unit is reused, the toner particles in the recovered liquid developer can be readily redispersed and reused.

In the invention, in Formula (I), R is the alkylene group having the carbon number of 2 to 6, but R is preferably the alkylene group having the carbon number of 2 to 4. If the carbon number of R is less than the lower limit, the secondary amine moiety of the dispersing agent cannot face the insulating liquid and sufficient dispersion stability and charge characteristics cannot be obtained. If the carbon number of R exceeds the upper limit, coagulation of the dispersing agents on the adjacent toner particles occurs and sufficient dispersion stability cannot be obtained, according to the carbon number of R' of Formula (I).

In Formula (I), R' is the alkyl group having the carbon number of 8 to 24, but R' is preferably the alkyl group having the carbon number of 8 to 20. If the carbon number of R' is less than the lower limit, the compatibility between the secondary amine moiety and the insulating liquid may deteriorate and thus sufficient dispersion stability cannot be obtained. If the carbon number of R' exceeds the upper limit, coagulation of the dispersing agents on the adjacent toner particles occurs and sufficient dispersion stability cannot be obtained.

The dispersing agent used in the invention may include plural types of compounds expressed by Formula (I) having different carbon numbers of R and different carbon numbers of R'.

Examples of the above-described dispersing agent include DUOMEEN CD, DUOMEEN T, DUOMEEN HT, and DUOMEEN OX ("DUOMEEN" is the product name of Lion Akzo Co., Ltd.), which can be used singularly or by combining two or more types of them.

The content of the dispersing agent in the liquid developer is preferably 1 to 10 parts by weight with respect to 100 parts by weight of the toner particles, more preferably 1 to 8 parts by weight, and most preferably 3.0 to 6 parts by weight. If the content of the dispersing agent is in the above range, the dispersibility of the toner particles can be efficiently improved and the charge characteristics of the positive charge are more excellent.

Insulating liquid

Next, the insulating liquid will be described.

The insulating liquid is a liquid having a sufficiently high insulation property and is preferably a liquid having an electric resistance of $10^{11}$ Ωcm or more at a room temperature (20° C.), more preferably $10^{12}$ Ωcm or more, and most preferably $10^{13}$ Ωm or more.

The specific permittivity of the insulating liquid is preferably 3.5 or less.

As the insulating liquid which satisfies these conditions, for example, mineral oils (hydrocarbon liquid) such as ISOPAR E, ISOPAR G, ISOPAR H, ISOPAR L (ISOPAR; product name, EXXON Corporation), Shellsol 70, Shellsol 71 (Shellsol; product name, SHELL OIL CO.), AMSCO OMS, AMSCO 460 solvent (AMSCO; product name, Spirits Corporation)and low-viscosity/high-viscosity liquid paraffin (Wako Pure Chemical Industries, Ltd.), fatty acid esters such as fatty acid glyceride, fatty acid monoester, and middle chain fatty acid ester, octane, isooctane, decane, isodecane, decalin, nonane, dodecane, isododecane, cyclohexane, cyclooctane, cyclodecane, benzene, toluene, xylene, and mesitylene may be used singularly or by combining two or more types of them. Among them, in particular, if hydrocarbon liquid or fatty acid ester is used, the dispersion stability of the toner particles is further improved.

Among them, if fatty acid monoester is used as the insulating liquid, the following effect can be obtained.

The fatty acid monoester is a component having the effect in which the toner particles are plasticated in a fixing process (plasticization effect). Accordingly, when heat and pressure are applied to a recording medium in the fixing process, it is possible to readily plasticate the toner particles by fatty acid monoester. The plasticated toner particles can be readily adhered to the recording medium. Additionally, the fatty acid monoester is a component having high compatibility with a resin material configuring the toner particles. Accordingly, the fatty acid monoester can be attached to the vicinities of the surfaces of the toner particles and the dispersibility of the toner particles can be improved. In addition, since the fatty acid monoester is susceptible to permeate into the recording medium, the fatty acid monoester attached to the vicinities of the surfaces of the toner particles rapidly permeates into the recording medium when the toner particles and the recording medium are brought into contact with each other in the fixing process. By the permeation of the fatty acid monoester, a portion of the toner particles (the resin material configuring the toner particles) melted by the heat in the fixing process permeates into the recording medium, an anchoring effect is caused, and fixing strength is improved. Since the fatty acid monoester can plasticate the toner particles even at a relatively low temperature, the insulating liquid including the fatty acid monoester has an excellent fixing property in a low temperature range. In addition, since the plasticated toner particles are brought into contact with each other and are melted, a desired color of the image can be obtained with certainty and color reproducibility is particularly excellent. In the fixing process, the plasticated toner particles are smoothened by a pressurizing roller or a fixing roller and the obtained toner image has high gloss. Since the fatty acid monoester is a component friendly to the environment, the load on the environment due to the insulating liquid, such as the leakage of the insulating liquid from the image forming apparatus or the disposal of used liquid developer, can be reduced. As a result, it is possible to provide a liquid developer friendly to environment.

Since the fatty acid monoester has compatibility with the above-described dispersing agent, the dispersion stability of the toner particles is higher.

If the insulating liquid including the fatty acid monoester is used, a difference between the viscosities of the liquid developers of respective colors is relatively small and a sharp image having a balance between the colors can be formed. That is, if the difference between the viscosities of the liquid developers of the respective colors is small, the coloring properties of the respective colors of the formed image can be readily adjusted by the development condition.

The viscosity of the fatty acid monoester is preferably 10 mPa·s or less and more preferably 5 mPa·s or less. Accordingly, the effect of decreasing the interface tension of acrylic fine particles is improved. As a result, the image which can be obtained on the recording medium becomes clear without unevenness. Accordingly, the toner particles suitably permeate into the recording medium and the toner particles melted by the heat in the fixing process permeate into the recording medium with certainty. If the viscosity of the fatty acid monoester is sufficiently small, the insulating liquid leaks out of the space between the toner particles and readily permeates into the recording medium. Accordingly, the toner image is susceptible to be adhered between the toner particles and melted in the fixing process and color reproducibility is excellent. For example, when the liquid developer is manufactured by the below-described method, the toner particles having a predetermined particle diameter can be suitably obtained. In the invention, the viscosity is measured on the basis of JIS Z8809 using a vibration-type viscometer at 25° C. unless a special description is made.

Although not specially limited, the fatty acid monoester which can be used in the liquid developer includes, for example, unsaturated fatty acid alkyl (methyl, ethyl, propyl, butyl or the like) monoester such as oleic acid, palmitoleic acid, linoleic acid, α-linolenic acid, γ-linolenic acid, arachidonic acid, docosahexaenoic acid (DHA) or eicosapentaenoic acid (EPA), or saturated fatty acid alkyl (methyl, ethyl, propyl, butyl or the like) monoester such as butyric acid, caproic acid, caprylic acid, capric acid, lauric acid, myristic acid, palmitic acid, stearic acid, arachidic acid, behenic acid or lignoceric acid, which can be used singularly or by combining two or more types of them.

The fatty acid monoester is ester of fatty acid and monohydric alcohol, but this alcohol is preferably alkyl alcohol having a carbon number of 1 to 4. Accordingly, the chemical stability of the liquid developer is excellent and the storage stability and long-term stability of the liquid developer is more excellent. The viscosity of the insulating liquid is suitable and the permeation of the liquid developer into the recording medium is more suitable. The alcohol may include methanol, ethanol, propanol, butanol and isobutanol.

If the fatty acid monoester is included in the insulating liquid, the content of the fatty acid monoester in the insulator liquid is preferably 1 to 50 wt % and more preferably 5 to 45 wt %. If the content of the fatty acid monoester in the insulating liquid is in the above-described range, the viscosity of the liquid developer is particularly suitable, the insulating liquid suitably leaks out of the space between the toner particles and the toner particles are particularly susceptible to be adhered and melted in the fixing process. In addition, the toner particles are particularly suitably plasticated, the toner particles are particularly susceptible to be adhered to each other, and the toner particles are particularly susceptible to be adhered to the recording medium. Accordingly, the liquid developer has excellent color reproducibility and excellent fixing property.

If the insulating liquid including the fatty acid glyceride, the following effects can be obtained.

The fatty acid glyceride is a component friendly to environment similar to the fatty acid monoester. Accordingly, it is possible to prevent the influence on the environment due to the volatilization of the insulating liquid and the waste of the liquid developer in the fixing process.

If the unsaturated fatty acid glyceride is included as the fatty acid glyceride, the following effects can be obtained.

The unsaturated fatty acid component configuring the unsaturated fatty acid glyceride is a component which improves the fixing strength of the toner particles to the recording medium. In more detail, the unsaturated fatty acid component is oxidized (oxidized at a fixing temperature in the fixing process) and hardened so as to improve the fixing strength of the toner particles. Accordingly, the fixing strength of the toner particles to the recording medium is excellent. The unsaturated fatty acid component is hardened such that additional recording can be readily performed using an aqueous ball-point pen with certainty with respect to the fixed toner image.

Although not specially limited, the unsaturated fatty acid configuring glyceride includes unsaturated fatty acid of monovalent unsaturated fatty acid such as crotonic acid, myristoleic acid, palmitoleic acid, oleic acid, elaidic acid, vaccenic acid, gadoleic acid, erucic acid or nervonic acid or multivalent unsaturated fatty acid such as linoleic acid, α-linolenic acid, γ-linolenic acid, arachidonic acid, eleostearic acid, stearidonic acid, arachidonic acid, clupanodonic acid, docosahexaenoic acid (DHA) or eicosapentaenoic acid (EPA), or derivatives thereof, which can be used singularly or by combining two or more types of them.

The fatty acid glyceride having the unsaturated fatty acid component can be obtained from, for example, natural fats of plant-derived fats such as safflower oil, rice oil, rice bran oil, colza oil, olive oil, canola oil, soybean oil, linseed oil, castor oil or sunflower seed oil, and from various animal-derived fats such as tallow.

The saturated fatty acid component may be included in the fatty acid glyceride. If the saturated fatty acid component is included, the chemical stability of the liquid developer or the insulation property of the insulating liquid is higher.

The saturated fatty acid configuring the saturated fatty acid component includes, for example, butyric acid, caproic acid, caprylic acid, capric acid, lauric acid, myristic acid, palmitic acid, stearic acid, arachidic acid, behenic acid or lignoceric acid, and one type or two or more types selected from them may be used. Among the saturated fatty acids, the carbon number in the molecule is preferably 6 to 22, more preferably 8 to 20, and most preferably 10 to 18. If the saturated fatty acid component including the saturated fatty acid is included, the above-described effects are obtained.

If the fatty acid glyceride and the fatty acid monoester are included as the insulating liquid, when the content ratio of the fatty acid glyceride in the insulating liquid is X [wt %] and the content ratio of the fatty acid monoester in the insulating liquid is Y [wt %] , it is preferable that a relationship of $1.0 \leqq x/Y \leqq 17.0$ is satisfied and it is more preferable that a relationship of $1.2 \leqq X/Y \leqq 5.0$ is satisfied. If this relationship is satisfied, the oxidation polymerization reaction of the unsaturated fatty acid component included in the fatty acid glyceride in the fixing process can be sufficiently performed. Since sufficient fatty acid monoester for plasticating the toner particles is attached to the surfaces of the toner particles in the fixing process and the toner particles are plasticated and melted, the image of exceptionally improved gloss can be obtained with the desired color. Additionally, since the plasctication is sufficiently performed, fixing strength of the toner image to the recording medium is excellent. If a large amount of fatty acid monoester is included in the insulating liquid, the liquid may permeate into the members of the image forming apparatus such that these members expand, but if the above-described relationship is satisfied, the expansion of the members due to the fatty acid monoester can be prevented with certainty.

In the liquid developer (insulating liquid), other components beside those described above may be included. As these other components, an antioxidizing agent or a charge control agent may be used.

The antioxidizing agent includes, for example, vitamin E such as tocopherol, d-tocopherol, dl-α-tocopherol, acetate-α-tocopherol, acetate dl-α-tocopherol, acetate tocopherol or α-tocopherol, phenolic antioxidant such as dibutylhydroxytoluene and butylhydroxyanisole, vitamin C such as ascorbic acid, ascorbate or ascorbyl stearate, green tea extract, raw coffee extract, sesamol, sesaminol, amine system antioxidizing agent, phospite system antioxidizing agent, and sulfur system antioxidizing agent, which can be used singularly or by combining two or more types of them.

The charge control agent includes, for example, metal oxide such as zinc oxide, aluminum oxide, magnesium oxide, a metal salt of benzoic acid, a metal salt of salicylic acid, a metal salt of alkyl salicylic acid, a metal salt of catechol, a metal-containing bisazo dye, a nigrosine dye, a tetraphenyl borate derivative, a quaternary ammonium salt, an alkylpyridinium salt, a chlorinated polyester, a nitrophnic acid, and a fatty acid metal salt, which can be used singularly or by combining two or more types of them.

Although not particularly limited, the viscosity of the insulating liquid is preferably 5 to 1000 mPa·s, more preferably 50 to800 mPa·s, and most preferably 100 to500 mPa·s. If the viscosity of the insulating liquid is in the above-described range, a predetermined amount of insulating liquid is attached to the toner particles when the liquid developer is supplied from a developer vessel to a coating roller, and the development property and the transfer property of the toner image are excellent. In addition, the dispersibility of the toner particles can be further improved and, in the below-described image forming apparatus, the liquid developer can be more uniformly supplied to the coating roller, and the dripping of the liquid developer from the coating roller can be more efficiently prevented. In addition, the cohesion and precipitation of the toner particles can be prevented and thus the dispersibility of the toner particles in the insulating liquid can be improved. In contrast, if the viscosity of the insulating liquid is less than the lower limit, problems such as dripping of the liquid developer from the coating roller and such may occur in the below-described image forming apparatus. On the other hand, if the viscosity of the insulating liquid exceeds the upper limit, the dispersibility of the toner particles cannot be sufficiently improved and thus, the liquid developer cannot be uniformly supplied to the coating roller in the below-described image apparatus. In the present specification, the viscosity value is measured at 25° C.

The electric resistance of the insulating liquid at a room temperature (20° C.) is preferably $1\times10^{9}$ Ωcm or more, more preferably $1\times10^{11}$ Ωcm or more, and most preferably $1\times10^{13}$ Ωcm or more.

The permittivity of the insulating liquid is preferably 3.5 or less.

Toner Particles

Next, the toner particles will be described.

Material Configuring Toner Particles

The toner particles include at least a binder resin (resin material) and a coloring agent.

1. Resin Material (Binder Resin)

The toner particles are formed of a material including a resin material as a main component.

In the invention, the resin (binder resin) is not particularly limited and, for example, known resin may be used.

In particular, as the resin material, a material having an ester bond is preferably used. Since the resin material having such a bond has a relatively large amount of carboxylic group which is an acid group, a larger amount of dispersing agents can be attached or absorbed to the surfaces of the toner particles. Accordingly, the positive charge characteristics of the toner particles can be further improved and the dispersion stability of the toner particles can be further improved.

The resin material having the ester bond includes, for example, a polyester resin, a styrene-acrylic acid ester copolymer, and a methacryl resin. Among them, in particular, the polyester resin is preferably used. The polyester resin has high transparency, thus when the polyester resin is used as the binder resin, the coloring property of the image can be improved.

However, since the polyester resin normally has negative charge characteristics or low charge characteristics (acid value is low), it is difficult to obtain sufficient charge characteristics if the polyester resin is applied to the positive charge toner particles (liquid developer) In contrast, in the invention, if such a dispersing agent is used, the effect described above caused by the use of the polyester resin can be efficiently obtained and the liquid developer having excellent positive charge characteristics can be obtained.

The polyester resin is synthesized by dehydration condensation of polybasic acid and multivalent alcohol.

The polybasic acid includes, for example, aromatic carboxylic acid such as terephthalic acid, isophthalic acid, phthalic anhydride, trimellitic anhydride, pyromellitic acid or naphthalenedicarboxylic acid; aliphatic carboxylic acid such as maleic anhydride, fumaric acid, succinic acid, alkenylsuccinic anhydride, or adipic acid; and alicyclic carboxylic acid such as cyclohexanedicarboxylic, which can be used singularly or by combining two or more types of them. Among the polybasic acids, the aromatic carboxylic acid is preferably used.

The multivalent alcohol includes, for example, aliphatic diols such as ethylene glycol, diethylene glycol, triethylene glycol, propylene glycol, butanediol, hexanediol, neopentyl glycol, glycerin, trimethylolpropane or pentaerythritol; alicyclic diols such as cyclohexane diol, cyclohexanedimethanol or hydrogenated bisphenol A; and aromatic diol such as ethylene oxide adduct of bisphenol A or propylene oxide adduct of bisphenol A, which can be used singularly or by combining two or more types of them. These multivalent alcohols may be used singularly or in combination of two or more types. Among the multivalent alcohols, the aromatic diols or alicyclic diols are preferably used and the aromatic diols are more preferably used.

With respect to the polyester resin which can be obtained, the acid value of the polyester resin can be adjusted by esterfying a hydroxyl group and/or a carboxyl group of the polymer terminal, by adding mono-carboxyl acid and/or mono alcohol. The mono-carboxyl acid includes, for example, acetate, acetic anhydride, benzoic acid, trichloroacetic acid, trifluoroacetic acid, and propionic anhydride. The mono alcohol includes, for example, methanol, ethanol, propanol, octanol, 2-ethylhexanol, trifluoroethanol, trichloroethanol, hexafluoroisopropanol, and phenol.

The acid value of the resin material used in the invention is preferably 5 to 20 mgKOH/g and more preferably 5 to 15 mgKOH/g. Accordingly, the dispersing agent can be more efficiently attached or absorbed to the surface of the toner base particle. In contrast, if the acid value of the resin material is less than the lower limit, it becomes more difficult for the dispersing agent to be attached to the surfaces of the toner particles and the cohesion between the toner particles cannot be sufficiently prevented. The dispersibility of the pigment in the toner particles may also decrease. If the toner particles are formed according to an emulsion coalescence process described below, it is difficult to form the toner particles having sufficient particle diameter. On the other hand, if the acid value of the resin material exceeds the upper limit, the negative charge characteristics of the resin material are strengthened and the desired charge characteristics of the positive charge cannot be sufficiently obtained.

The glass transition temperature Tg of the resin material is preferably 15 to 70° C. and more preferably 20 to 55° C. Accordingly, in the storage of the liquid developer including the manufactured toner particles, the cohesion and the fusion of the toner particles are suppressed with certainty and the storage of the liquid developer is more excellent. In addition, the toner particles can be more suitably fixed on the recording medium at a low temperature. In the present specification, the glass transition temperature Tg is a temperature of an intersection between a tangent line representing a maximum slope between the extension line of the baseline of the glass transition point or less and a point from the rising portion of a peak to the apex of the peak when measurement is performed under a measurement condition of a differential scan calorific value measuring instrument (DSC-220 C (manufactured by SII)) in which a sample amount is 10 mg, a temperature rising speed is 10° C./min and a measurement temperature range is 10 to 150° C.

Although not specially limited, the softening temperature (T1/2) of the resin material is preferably 50 to 130° C., more preferably 50 to 120° C., and most preferably 60 to 115° C. In the present specification, the softening temperature indicates an initial softening temperature defined in a measurement condition of a Koka-type flow tester (manufactured by Shimadzu Corporation) in which a temperature rising speed is 5° C./min and a die hole diameter is 1.0 mm.

2. Coloring Agent

The toner may include a coloring agent. Although not particularly limited, the coloring agent may use, for example, known pigment and dye.

3. Other Components

The toner may include other components. These components include, for example, known wax or magnetic powder.

As the material (component) of the toner particles, in addition to the above-described materials, for example, zinc stearate, zinc oxide, cerium oxide, silica, titanium oxide, iron oxide, fatty acid, and fatty acid metal salt.

Shape of Toner Particles

The average particle diameter of the toner particles including the above-described materials is preferably 0.5 to 3 μm, more preferably 1 to 2.5 μm, and most preferably 1 to 2 μm. If the average particle diameter of the toner particles is in the above-described range, a deviation in the characteristics between the toner particles is small, the reliability of the liquid developer is high, and the resolution of the toner image formed by the liquid developer is sufficiently high. In addition, the dispersion of the toner particles into the insulating liquid is good and the storage of the liquid developer is improved. In the present specification, the "average particle diameter" indicates the average particle diameter based on volume.

The content ratio of the toner particles in the liquid developer is preferably 10 to 60 wt % and more preferably 20 to 50 wt %.

Method of Manufacturing Liquid Developer

Next, a method of manufacturing a liquid developer according to an embodiment of the invention will be described.

The method of manufacturing the liquid developer of the present embodiment includes a dispersion liquid manufacturing process which manufactures a dispersion liquid in which a resin material and a coloring agent are dispersed in an aqueous dispersion medium; a compounding process which compounds a plurality of dispersoids and obtains compounded particles; a solvent-removing process which removes an organic solvent included in the compounded particles and obtains toner particles including the resin material and the coloring agent; and a dispersing process which disperses the toner particles and the above-described dispersing agent in an insulating liquid.

Hereinafter, the processes configuring the method of manufacturing the liquid developer will be described in detail.

Dispersion Liquid Manufacturing Process (Aqueous Dispersion Liquid Manufacturing process)

First, the dispersion liquid (aqueous dispersion liquid) is manufactured.

The aqueous dispersion liquid may be manufactured by any method. For example, the materials (toner materials) configuring the toner particles, such as the resin material and the coloring agent, are melted and dispersed in an organic solvent so as to obtain a resin liquid (resin liquid manufacturing process) and the aqueous dispersion medium constituted by an aqueous liquid is added to the resin liquid so as to form the dispersoid (liquid type dispersoid) including the toner materials and the dispersion liquid (aqueous dispersion liquid) in which the dispersoid is dispersed is obtained (dispersoid forming process).

Resin Liquid Manufacturing Process

First, the resin material and a hydrolysis suppressant are melted or dispersed in the organic solvent so as to manufacture the resin liquid.

The manufactured resin liquid includes the above-described materials configuring the toner particles and the below-described organic solvent.

As the organic solvent, any solvent which melts at least a portion of the resin material may be used and a solvent having a lower boiling point than that of the below-described aqueous liquid is preferably used. Accordingly, the organic solvent can be readily removed.

As the organic solvent, an organic solvent having poor compatibility with the below-described aqueous dispersion medium (aqueous liquid) (for example, the solubility of the organic solvent with respect to the aqueous dispersion medium of 100 g at 25° C. is 30 g or less) is preferable. Accordingly, in the aqueous emulsified liquid, the toner materials are finely dispersed in a stable state.

The composition of the organic solvent may be properly selected, for example, according to the above-described resin material, the composition of the coloring agent or the composition of the aqueous dispersion medium.

Although not particularly limited, the organic solvent includes, for example, a ketone solvent such as MEK and an aromatic hydrocarbon solvent such as toluene.

The resin liquid can be obtained, for example, by agitating the resin material, the coloring agent and the organic solvent by an agitator. The agitator which can be used for manufacturing the resin liquid includes, for example, a high-speed agitator such as DESPA (manufactured by ASADA IRON WORKS. CO., LTD.) and T. K. Robomics/T. K. Homo Disper-2.5 type blade (manufactured by Primix Corporation).

The material temperature at the time of agitating is preferably 20 to 60° C. and more preferably 30 to 50° C.

Although not particularly limited, the content ratio of the solid content in the resin liquid is preferably 40 to 75 wt %, more preferably 50 to 73 wt % and most preferably 50 to 70 wt %. If the content ratio of the solid content is in the above-described range, the dispersion medium configuring the below-described dispersion liquid (emulsified suspension) has higher sphericity (shape close to a sphere) and thus the shape of the toner particles which can be finally obtained is more suitable.

In the manufacture of the resin liquid, all the components configuring the resin liquid to be manufactured may be simultaneously mixed or portions of the components configuring the resin liquid to be manufactured may be previously mixed to obtain a mixture (master) in advance and afterwards the mixture (master) may be mixed with the other components.

Dispersion Medium Forming Process

Next, the aqueous dispersion liquid (dispersion liquid) is manufactured.

The aqueous dispersion medium constituted by the aqueous liquid is added to the resin liquid such that the dispersion medium (liquid dispersion medium) including the toner materials is formed in the aqueous liquid, and the dispersion liquid (aqueous dispersion liquid) in which the dispersoid is dispersed is obtained.

The aqueous dispersion medium is constituted by the aqueous liquid.

The aqueous liquid may include water as a main component.

In the aqueous liquid, for example, a solvent having excellent compatibility with water (for example, a solvent of which solubility is 50 parts by weight or more with respect to water of 100 parts by weight at 25° C.) may be included.

An emulsified dispersing agent may be added to the aqueous dispersion medium, if necessary. By adding the emulsified dispersing agent, the aqueous emulsified liquid can be more readily manufactured.

Although not particularly limited, as the emulsified dispersing agent, for example, known emulsified dispersing agent may be used.

In the manufacture of the aqueous dispersing liquid, for example, a neutralizing agent may be used. Accordingly, for example, a functional group (for example, carboxyl group or the like) having the resin material may be neutralized and thus the shape of the dispersoid, the uniformity of the size of the dispersoid and the dispersibility of the dispersoid in the manufactured aqueous dispersion liquid are excellent. Accordingly, the toner particles which can be obtained have a narrow particle size distribution.

The neutralizing agent may be, for example, added to the resin liquid or added to the aqueous liquid.

The neutralizing agent may be divided and added plural times in the manufacture of the aqueous dispersion liquid.

The neutralizing agent may use a basic compound and more particularly, and specifically, for example, inorganic base such as sodium hydroxide, potassium hydroxide and ammonia, or organic base such as diethylamine, triethylamine and isopropylamine, which can be used singularly or by combining two or more types of them. The neutralizing agent may be an aqueous liquid including the above-described compound.

The usage of the basic compound is preferably one to three times (1 to 3 equivalent amount) and more preferably one to two times (1 to 2 equivalent amount) of the amount necessary for neutralizing the whole carboxyl group included in the resin material. Accordingly, the deformed dispersoid can be efficiently prevented from being formed and the particle size distribution of the particles which can be obtained in the compounding process described below in detail can become sharper.

The addition of the aqueous liquid to the resin liquid may be performed by any method, but an aqueous liquid including water is preferably added to the resin liquid while agitating the resin liquid. That is, while shear is applied to the resin liquid by the agitator, the aqueous liquid is gradually added (dropped) to the resin liquid, the phase is inverted from a W/O type emulsified liquid to an O/W type emulsified liquid, and, as a result, the aqueous dispersion liquid in which the dispersoid derived from the resin liquid is dispersed is preferably obtained in the aqueous liquid.

The agitator which can be used for manufacturing the aqueous dispersion liquid may include, for example, a high-speed agitator such as DESPA (manufactured by ASADA IRON WORKS. CO., LTD.), T. K. Robomics/T. K. Homo Disper-2.5 type blade (manufactured by Primix Corporation), Slasher (manufactured by MITSUI MINING. CO., LTD.) or CAVITRON (manufactured by Eurotec Ltd.) or a high-speed disperser.

When the aqueous liquid is added to the resin liquid, the agitation is preferably performed such that the speed of the front end of the blade becomes 10 to 20 m/sec and more preferably 12 to 18 m/sec. If the speed of the front end of the blade is in the above-described range, the aqueous dispersion liquid can be efficiently obtained and a deviation in the shape and the size of the dispersoid in the aqueous dispersion liquid can be particularly reduced and the uniform dispersibility of the dispersoid is excellent while preventing an excessively fine dispersoid or a large particles from being generated.

Although not particularly limited, the content ratio of the solid content in the aqueous dispersion liquid is preferably 5 to 55 wt % and more preferably 10 to 50 wt %. Accordingly, the productivity of the toner particles is excellent while preventing the undesired cohesion between the dispersoids in the aqueous dispersion liquid with certainty.

The material temperature in the present process is preferably 20 to 60° C. and more preferably 20 to 50C.

Compounding Process

Next, the plurality of dispersoids are compounded so as to obtain compounded particles (compounding process). The compounding of the dispersoids is generally performed by impacting the dispersoids including the organic solvent.

The compounding of the plurality of dispersoids is performed by adding an electrolyte to the dispersion liquid while agitating the dispersion liquid. Accordingly, the compounded particles can be readily obtained with certainty. By adjusting the amount of the added electrolyte, the diameter of the compounded particles and the particle size distribution can be readily controlled with certainty.

Although not particularly limited, as the electrolyte, one type or two or more types of the known organic and inorganic water-soluble base may be combined and used.

The electrolyte is preferably monovalent cation base. Accordingly, the particle size distribution of the compounded particles which can be obtained may become narrow. If the monovalent cation base is used, it is possible to prevent large particles from being generated in the present process with certainty.

Among the descriptions mentioned above, electrolytes such as sulfate (for example, sodium sulfate or ammonium sulfate) or carbonate is preferably used, but sulfate is more preferably used. Accordingly, it is possible to readily control the diameter of the compounded particles.

The amount of the electrolyte added in the present process is preferably 0.5 to 3 parts by weight and more preferably 1 to 2 parts by weight with respect to the 100-parts by weight solid content included in the dispersion liquid to which the electrolyte is added. Accordingly, it is possible to readily control the diameter of the compounded particles with certainty and prevent large particles from being generated with certainty.

The electrolyte is preferably added in an aqueous solution state. Accordingly, the electrolyte can be rapidly spread in the whole dispersion liquid and the amount of added electrolyte can be readily controlled with certainty. As a result, the compounded particles of a desired diameter, particularly compounded particles with a narrow particle size distribution can be obtained.

If the electrolyte is added in the aqueous solution state, the concentration of the electrolyte in the aqueous solution is preferably 2 to 10 wt % and more preferably 2.5 to 6 wt %. Accordingly, the electrolyte can be rapidly spread in the whole dispersion solution and the amount of added electrolyte can be readily controlled with certainty. By adding such the aqueous solution, the content of water in the dispersion liquid at the completion of the adding of the electrolyte is suitably adjusted. Accordingly, the growth speed of the compounded particles after the electrolyte is added is properly decreased without deteriorating the productivity. As a result, it is possible to control the diameter of the particles with certainty. In addition, it is possible to prevent the compounding of undesirable compounded particles with certainty.

If the electrolyte is added in the aqueous solution state, the adding speed of the aqueous electrolyte solution is preferably 0.5 to 10 parts by weight/min and more preferably 1.5 to 5 parts by weight/min with respect to the 100-parts by weight solid content included in the dispersion liquid to which the aqueous electrolyte solution is added. Accordingly, it is possible to prevent unevenness of the concentration of the electrolyte in the dispersion liquid from being generated and prevent large particles from being generated with certainty. The particle size distribution of the compounded particles can become narrow. By adding the electrolyte at this speed, it is possible to readily control the compounding speed, readily control the average particle diameter of the compounded particles, and improve the productivity of the toner.

The adding of the electrolyte may be divided and performed plural times. Accordingly, it is possible to readily obtain the compounded particles having a desired size with certainty and increase the degree of circularity of the compounded particles which can be obtained.

The present process is performed in a state in which the dispersion liquid is agitated. Accordingly, it is possible to obtain the compounded particles having a small deviation between the shapes and the sizes of the particles.

For the agitation of the dispersion liquid, agitation blades, for example, an anchor blade, a turbine blade, a faudler blade, a full-zone blade, a Max blend blade or a semicircular blade maybe used. Among them, the Max blend blade or the Full-zone blade is preferable. Accordingly, the added electrolyte is uniformly and rapidly dispersed and melted and the unevenness of the concentration of the electrolyte can be prevented from being generated with certainty. The compounded particles can be prevented from being destroyed with certainty while efficiently compounding the dispersoids. As a result, it is possible to efficiently obtain the compounded particles having a small deviation between the shape and the particle diameter of the particles.

The speed of the front end of the blade of the agitation blade is preferably 0.1 to 10 m/sec, 0.2 to 8 m/sec, and most preferably 0.2 to 6 m/sec. If the speed of the front end of the blade is in the above-described range, the added electrolyte is uniformly and rapidly dispersed and melted and the unevenness of the concentration of the electrolyte can be prevented from being generated with certainty. The compounded particles can be prevented from being destroyed with certainty while efficiently compounding the dispersoids.

The average particle diameter of the compounded particles which can be obtained is preferably 0.5 to 5 μm and more preferably 1.5 to 3 μm. Accordingly, the suitable diameter of the toner particles which can be finally obtained is achieved.

Solvent-Removing Process

Thereafter, the organic solvent included in the dispersion liquid is removed. Accordingly, the resin fine particles (toner particles) dispersed in the dispersion liquid can be obtained.

The removal of the organic solvent may be performed by any method, for example, depressurization. Accordingly, it is possible to efficiently remove the organic solvent while sufficiently preventing the deformation of the material such as the resin material.

The preferable temperature of the present process is a temperature lower than the glass transition point (Tg) of the resin material configuring the compounded particles.

The present process may be performed in a state in which an antifoaming agent is added to the dispersion liquid. Accordingly, it is possible to efficiently remove the organic solvent.

As the antifoaming agent, for example, lower alcohols, higher alcohols, fats, fatty acids, ester fatty acids, or ester phosphate may be used in addition to a mineral oil type antifoaming agent, a polyether type antifoaming agent and a silicon type antifoaming agent.

Although not particularly limited, the usage of the antifoaming agent is preferably 20 to 300 ppm and more preferably 30 to 100 ppm in ratio by weight with respect to the solid content included in the dispersion liquid.

In the present process, at least a portion of the aqueous liquid may be removed together with the organic solvent.

In the present process, the total organic solvent (total amount of the organic solvent included in the dispersion liquid may not be necessarily removed. Even in this case, in the other below-described processes, the remaining organic solvent can be sufficiently removed.

Cleaning Process

Next, the obtained resin fine particles (toner particles) are cleaned (cleaning process).

By performing the present process, the organic solvent which is included as an impurity can be efficiently removed. As a result, in the resin fine particles which can be finally obtained, volatile organic compound (TVOC) amount can be especially reduced.

The present process may be performed, for example, by dividing the resin fine particles by solid-liquid separation (separation from the aqueous liquid) and thereafter, by making the redispersion and solid-liquid separation (separation of the resin fine particles from the aqueous liquid) of the solid content (resin fine particles) into water. The redispersion and the solid-liquid separation of the solid content into water may be repeatedly performed plural times.

Drying Process

Thereafter, the drying process is performed such that the toner particles can be obtained (drying process).

The drying process may be performed, for example, using a vacuum drier (for example, RIBOCONE (manufactured by OKAWARAMFG. CO., LTD,), Nauta (manufactured by Hosokawa Micron Corporation) or the like or a fluidized bed dryer (manufactured by OKAWARA MFG. CO., LTD.).

Dispersing Process

Next, the obtained toner particles and the above-described dispersing agent are dispersed in the insulating liquid. Accordingly, a liquid developer is obtained.

The dispersion of the toner particles and the dispersing agent into the insulating liquid may be performed using any method, for example, by mixing the insulating liquid, the toner particles and the dispersing agent by a bead mill or a ball mill. By mixing according to these processes, the dispersing agent can be attached or absorbed to the surfaces of the toner particles with certainty.

At the time of dispersion, other components may be mixed in addition to the insulating liquid, the toner particles and the dispersing agent.

The dispersion of the toner particles and the dispersing agent in the insulating liquid may be performed using the total amount of insulating liquid configuring the liquid developer which can be finally obtained or a portion of the insulating liquid.

If the toner particles and the dispersing agent are dispersed using a portion of the insulating liquid, the same liquid as the liquid used for the dispersion may be added as the insulating liquid after the dispersion, or a liquid different from the liquid used for the dispersion may be added as the insulating liquid after the dispersion. In the latter case, the characteristics such as the viscosity of the liquid developer which can be finally obtained can be readily adjusted. If the liquid used for the dispersion is a monoester fatty acid, the toner particles can be plasticated with certainty.

If the liquid developer is manufactured by the above-described method, the configuring materials are uniformly dispersed in the included toner particles and the deviation between the shapes of the toner particles is reduced. Accordingly, the surface areas of the particles become uniform and thus the dispersing agent can be uniformly attached or absorbed to the surfaces of the toner particles. As a result, the deviation between the charge characteristics of the toner particles can be efficiently suppressed and the configuration can be simplified even in the developing and transferring processes.

Image Forming Apparatus

Next, an image forming apparatus according to an embodiment of the present invention will be described. The image forming apparatus according to the embodiment of the invention forms a color image on a recording medium using the liquid developer of the embodiment of the invention.

Figure 2:
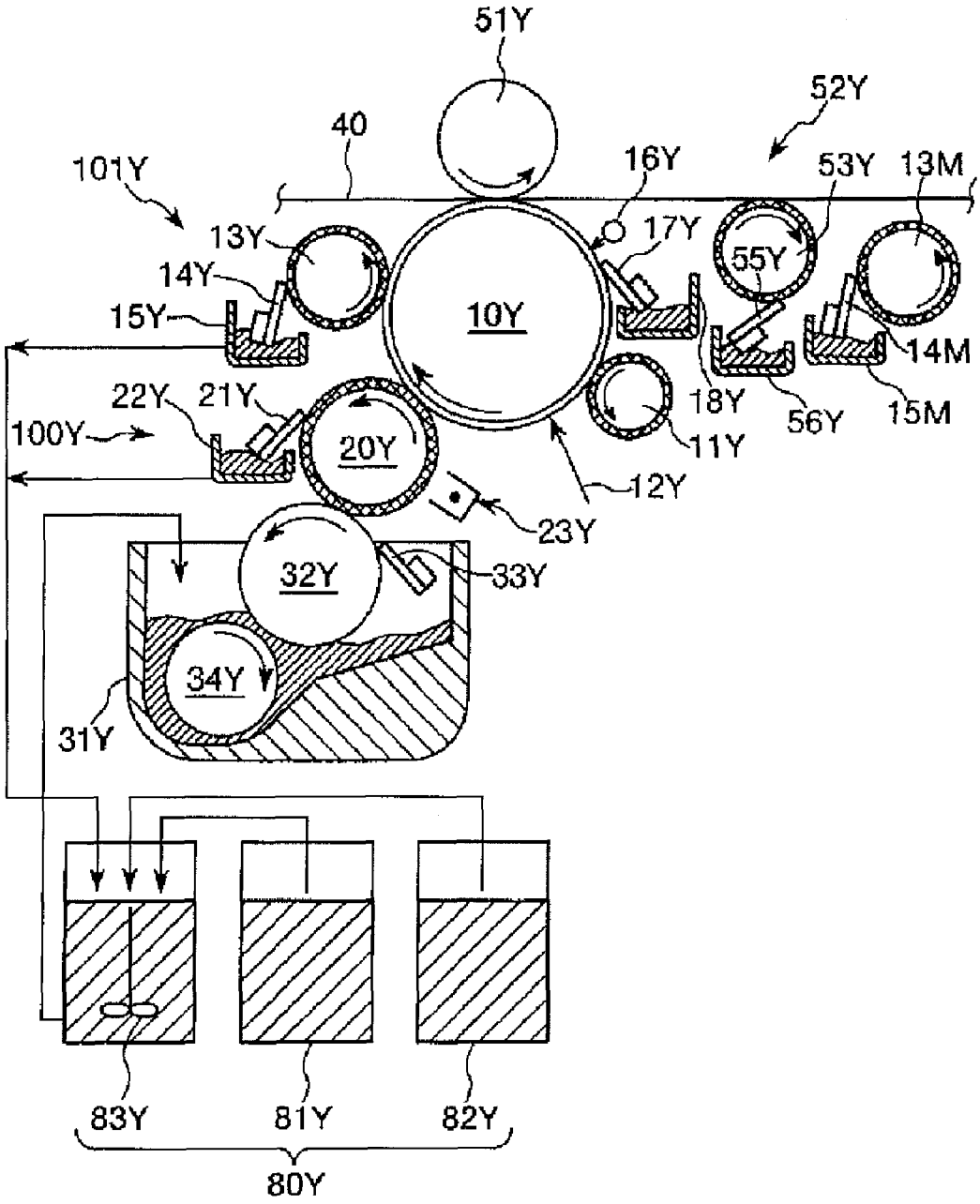
FIG. 2 is an enlarged view showing a portion of the image forming apparatus shown in FIG. 1.

FIG. 1 is a schematic view showing an image forming apparatus using the liquid developer according to a second embodiment of the invention and FIG. 2 is an enlarged view showing a portion of the image forming apparatus shown in FIG. 1.

As shown in FIGS. 1 and 2, the image forming apparatus 1000 includes four development portions 30Y, 30M, 30C and 30K, an intermediate transferring portion 40, a secondary transferring unit (secondary transferring portion) 60, a fixing portion (fixing device) F40, and four liquid developer supplying portions 80Y, 80M, 80C and 80K.

The development portions 30Y, 30M, 30C respectively have functions for developing the latent images by a yellow liquid developer (Y), a magenta liquid developer (M) and a cyan liquid developer (C) and forming single-color images corresponding to the respective colors. The development portion 30K has a function for developing the latent image by a black liquid developer (K) and forming a black single-color image.

The development portions 30Y, 30M, 30C and 30K have the same configuration and thus only the development portion 30Y will be described.

As shown in FIG. 2, the development portion 30Y includes a photosensitive body 10Y which is an example of an image carrier, a charge roller 11Y, an exposure unit 12Y, a development unit 100Y, a photosensitive body squeeze device 110Y, and a primary transfer backup roller 51Y, a neutralization unit 16Y, a photosensitive body cleaning blade 17Y and a developer recovery portion 18Y, in the rotation direction of the photosensitive body 10Y.

The photosensitive body 10Y has a cylindrical base and a photosensitive layer which is formed on the outer circumferential surface of the base and is formed of a material such as amorphous silicon, can be rotated about a central axis, and can be rotated in clockwise direction as shown in an arrow of FIG. 2, in the present embodiment.

The liquid developer is supplied to the photosensitive body 10Y by the development unit 100Y such that the layer of the liquid developer is formed on the surface of the development unit.

The charge roller 11Y charges the photosensitive body 10Y and the exposure unit 12Y forms the latent image on the charged photosensitive body 10Y by irradiating laser. The exposure unit 12Y has a semiconductor laser, a polygon mirror and an F-θ lens and irradiates modulated laser on the charged photosensitive body 10Y on the basis of an image signal received from a host computer (not shown) such as a personal computer or a word processor.

The development unit 100Y is a device for developing the latent image formed on the photosensitive body 10Y using the liquid developer according to the embodiment of the invention. The development units 100Y will be described in detail later.

The photosensitive body squeeze device 101Y is arranged so as to face the photosensitive body 10Y at the downstream side of the rotation direction of the development unit 100Y and includes a photosensitive body squeeze roller 13Y, a cleaning blade 14Y which is slidably brought into contact with the photosensitive body squeeze roller 13Y and removes the liquid developer attached to the surface, and a developer recovering portion 15Y for recovering the removed liquid developer. The photosensitive body squeeze device 101Y has a function for recovering the originally unnecessary fogging toner and the remaining carrier (insulating liquid) from the developer developed on the photosensitive body 10Y, and increasing the toner particle ratio of the formed image.

The primary transfer backup roller 51Y transfers the single-color image formed on the photosensitive body 10Y onto the intermediate transferring portion 40 described below.

The neutralization unit 16Y removes the charges remaining on the photosensitive body 10Y after the intermediate transfer image is transferred onto the intermediate transferring portion 40 by the primary transfer backup roller 51Y.

The photosensitive body cleaning blade 17Y is formed of rubber which is in contact with the surface of the photosensitive body 10Y and has a function for scraping and removing the liquid developer remaining on the photosensitive body 10Y after the image is transferred onto the intermediate transferring portion 40 by the primary transfer backup roller 51Y.

The developer recovering portion 18Y has a function for recovering the liquid developer removed by the photosensitive body cleaning blade 17Y.

The intermediate transferring portion 40 is an endless elastic belt member and is stretched over a belt driving roller 41 to which the driving force of a motor (not shown) and a pair of driven rollers 42 and 43 are applied. The intermediate transferring portion 40 is rotated by the belt driving roller 41 in a counterclockwise direction while the primary transfer backup rollers 51Y, 51M, 51C and 51K are in contact with the photosensitive bodies 10Y, 10M, 10C and 10K.

Predetermined tension is applied to the intermediate transferring portion 40 by a tension roller 44 such that Taxation is removed. The tension roller 44 is arranged on the downstream side of the rotation (movement) direction of the intermediate transferring portion 40 rather than the driven roller 42 and the upstream side of the rotation (movement) direction of the intermediate transferring portion 40 rather than the driven roller 43.

The single-color images of the respective colors, which are formed by the development portions 30Y, 30M, 30C and 30K, are sequentially transferred onto the intermediate transferring portion 40 by the primary transfer backup rollers 51Y, 51, 51C and 51K and are overlapped with each other. Accordingly, the full-color developer image (intermediate transfer image) is formed on the intermediate transferring portion 40.

The single-color images formed on the plurality of photosensitive bodies 10Y, 10M, 10C and 10K are sequentially secondarily transferred onto the intermediate transferring portion 40 to be overlapped with each other and are transferred as a bundle onto the recording medium F5 such as paper, a film and a cloth by the below-described secondary transferring unit 60. Accordingly, when the toner image is transferred onto the recording medium F5 the in the secondary transferring process, an elastic belt member is employed as a unit for improving the secondary transfer characteristics conforming to the surface of an unsmooth sheet material, even if the recording medium F5 is an unsmooth sheet material due to fibroid material and the like.

In the intermediate transferring portion 40, a cleaning device including an intermediate transferring portion cleaning blade 46, a developer recovering portion 47, a non-contact bias applying member 48 is arranged.

The intermediate transferring unit cleaning blade 46 and the developer recovering portion 47 are arranged on the side of the driven roller 43.

The intermediate transferring portion cleaning blade 46 has a function for scraping and removing the liquid developer attached on the intermediate transferring portion 40 after the image is transferred onto the recording medium F5 by the secondary transferring unit (secondary transferring portion) 60.

The developer recovering portion 47 has a function for recovering the liquid developer removed by the intermediate transferring unit cleaning blade 46.

The non-contact bias applying member 48 is arranged to be spaced from the intermediate transferring portion 40 at a position facing the tension roller 44. The non-contact bias applying member 48 applies a bias voltage, which is a reverse polarity of the toner, to the toner (solid content) of the liquid developer remaining on the intermediate transferring portion 40 after the secondary transfer. Accordingly, the toner is neutralized such that the electrostatic attachment force of the toner to the intermediate transferring portion 40 is reduced. In this example, a corona charger is used as the non-contact bias applying member 48.

The non-contact bias applying member 48 does not necessarily need to be arranged at a position facing the tension roller 44 and, for example, may be arranged between the driven roller 42 and the tension roller 44 or may be arranged at any position where is the downstream side of the movement direction of the intermediate transferring portion rather than the driven roller 42 and the upstream side of the movement direction of the intermediate transferring portion rather than the driven roller 43. As the non-contact bias applying member 48, a known non-contact charger may be used instead of the corona charger.

An intermediate transferring portion squeeze device 52Y is arranged on the downstream side of the movement direction of the intermediate transferring portion 40 rather than the primary transfer backup roller 51Y.

The intermediate transferring portion squeeze device 52Y is provided as a unit for removing the remaining insulating liquid from the transferred liquid developer if the liquid developer transferred onto the intermediate transferring portion 40 does not reach a desired dispersion state.

The intermediate transferring portion squeeze device 52Y includes an intermediate transferring portion squeeze roller 53Y, an intermediate transferring portion squeeze cleaning blade 55Y which is slidably brought into contact with the intermediate transferring portion squeeze roller 53Y and cleans the surface of the intermediate transferring portion squeeze roller, and a developer recovering portion 56Y for recovering the liquid developer removed from the intermediate transferring portion squeeze cleaning blade 55Y.

The intermediate transferring portion squeeze device 52Y has a function for recovering the remaining insulating liquid from the developer (single-color image) primarily transferred onto the intermediate transferring portion 40, increasing the toner particle ratio in the image, and recovering the originally unnecessary fogging toner.

The secondary transferring unit 60 has a pair of secondary transfer rollers which are spaced from each other with a predetermined gap in the movement direction of the transfer material. Between the pair of secondary transfer rollers, the secondary transfer roller arranged on the upstream side of the movement direction of the intermediate transferring portion 40 is the upstream secondary transfer roller 61. The upstream secondary transfer roller 61 is pressurized to the belt driving roller 41 with the intermediate transferring portion 40 interposed therebetween.

Between the pair of secondary transfer rollers, the secondary transfer roller arranged on the downstream side of the movement direction of the transfer material is the downstream secondary transfer roller 62. The downstream secondary transfer roller 62 is pressurized to the driven roller 42 with the intermediate transferring portion 40 interposed therebetween.

That is, the upstream secondary transfer roller 61 and the downstream secondary transfer roller 62 bring the recording medium F5 into contact with the intermediate transferring portion 40 stretched over the belt driving roller 41 and the driven roller 42 such that the intermediate transfer image formed on the intermediate transferring portion 40 is secondarily transferred onto the recording medium F5.

In this case, the belt driving roller 41 and the driven roller 42 function as the backup rollers of the upstream secondary transfer roller 61 and the downstream secondary transfer roller 62. That is, the belt driving roller 41 also functions as the upstream backup roller arranged on the upstream side of the movement direction of the recording medium F5 rather than the driven roller 42 in the secondary transferring unit 60. In addition, the driven roller 42 also functions as the downstream backup roller arranged on the downstream side of the movement direction of the recording medium F5 rather than the belt driving roller 41 in the secondary transferring unit 60.

Accordingly, the recording medium F5 transported to the secondary transferring unit 60 is closely in contact with the intermediate transferring portion 40 in a predetermined movement region of the transfer material from a pressurization start position (nip start position) between the upstream secondary transfer roller 61 and the belt driving roller 41 to the pressurization end position (nip end position) between the downstream secondary transfer roller 62 and the driven roller 42. Accordingly, since the full-color intermediate transfer image on the intermediate transferring portion 40 is secondarily transferred onto the recording medium F5 which is closely in contact with the intermediate transferring portion 40 over a predetermined time, the good secondary transfer is performed.

The secondary transferring unit 60 includes a secondary transfer roller cleaning blade 63 and a developer recovering portion 64 with respect to the secondary transfer roller 61. The secondary transferring unit 60 includes a secondary transfer roller cleaning blade 65 and a developer recovering portion 66 with respect to the secondary transfer roller 62. The secondary transfer roller cleaning blades 63 and 65 are respectively brought into contact with the secondary transfer rollers 61 and 62 and scrape and remove the liquid developer remaining on the surfaces of the secondary transfer rollers 61 and 62 after the secondary transfer. The developer recovering portions 64 and 66 each recover and store the liquid developer scraped from each of the secondary transfer rollers 61 and 62 by the secondary transfer roller cleaning blades 63 and 65.

The toner image (transfer image) F5*a* transferred onto the recording medium F5 by the secondary transferring unit 60 is sent to the below-described fixing portion (fixing device) F40 and the fixing process is performed.

Next, the development units 100Y, 100M, 100C and 100K will be described in detail. In the following description, only the development unit 100Y will be representatively described.

As shown in FIG. 2, the development unit 100Y includes a liquid developer storage portion 31Y, a coating roller 32Y, a regulation blade 33Y, a developer agitation roller 34Y, a development roller 20Y, a development roller cleaning blade 21Y, and a corona discharger (compression unit) 23Y.

The liquid developer storage portion 31Y has a function for storing the liquid developer for developing the latent image formed on the photosensitive body 10Y.

The coating roller 32Y has a function for supplying the liquid developer to the development roller 20Y.

The coating roller 32Y is called an Anilox roller in which grooves are spirally and uniformly formed in the surface of the roller formed of metal such as iron and is plated with nickel, and the diameter thereof is about 25 mm. In the present embodiment, a plurality of grooves is formed obliquely to the rotation direction of the coating roller 32Y by a so-called cutting process or a rolling process. The coating roller 32Y is brought into contact with the liquid developer while rotating in the counterclockwise direction such that the liquid developer in the liquid developer storage portion 31Y is carried in the grooves, and the carried liquid developer is transported to the development roller 20Y.

The regulation blade 33Y is brought into contact with the surface of the coating roller 32Y and regulates the amount of liquid developer on the coating roller 32Y. That is, the regulation blade 33Y scrapes off the liquid developer remaining on the coating roller 32Y and measures the liquid developer on the coating roller 32Y supplied to the development roller 20Y. The regulation blade 33Y is formed of urethane rubber as an elastic body and is supported by a regulation blade support member made of metal such as iron. The regulation blade 33Y is provided on the side where the coating roller 32Y rotates and travels from the liquid developer (that is, the right side of FIG. 2). The rubber hardness of the regulation blade 33Y is about 77 degrees by JIS-A and the hardness of the portion of the regulation blade 33Y which is in contact with the surface of the coating roller 32Y (about 77 degrees) is lower than the hardness of the portion of the elastic layer of the development roller 20Y which is pressurized to the surface of the coating roller 32Y (about 85 degrees). The scraped remaining liquid developer is recovered in the liquid developer storage portion 31Y and is reused.

The developer agitation roller 34Y has a function for agitating the liquid developer such that the liquid developer is in the uniform dispersion state. Accordingly, even when the plurality of toner particles 1 are cohered, the toner particles 1 can be suitably dispersed. In particular, since the dispersibility of the toner particles is high in the liquid developer according to the embodiment of the invention, the toner particles can be more suitably dispersed. Even in the liquid developer which is reused, the toner particles can be readily dispersed.

In the liquid developer storage portion 31Y, the toner particles 1 in the liquid developer have plus charges, the liquid developer is agitated by the developer agitation roller 34Y so as to become the uniform dispersion state, and the coating roller 32Y rotates such that the liquid developer is supplied from the liquid developer storage portion 31Y, the amount of liquid developer is regulated by the regulation blade 33Y, and the liquid developer is supplied to the development roller 20Y.

Since the development roller 20Y develops the latent image carried on the photosensitive body 10Y by the liquid developer, the development roller 20Y carries and transports the liquid developer to the development position facing the photosensitive body 10Y.

The development roller 20Y forms a liquid developer layer 201Y by supplying the liquid developer from the coating roller 32Y to the surface thereof.

The development roller 20Y has an elastic layer having conductivity on the outer circumferential portion of an inner core made of metal such as iron and the diameter thereof is about 20 mm. The elastic layer has a two-layer structure: an urethane rubber having rubber hardness of about 30 degree by JIS-A and a thickness of about 5 mm as an internal layer, and an urethane rubber having rubber hardness of about 85 degrees by JIS-A and a thickness of about 30 μm as an external layer. The external layer of the development roller 20Y becomes a pressurization portion and the development roller is pressurized to the coating roller 32Y and the photosensitive body 10Y in an elastically deformed state.

The development roller 20Y can rotate about the central shaft thereof and the central shaft is placed below the central rotation shaft of the photosensitive body 10Y. The development roller 20Y rotates in the direction (counterclockwise direction of FIG. 2) reverse to the rotation direction (clockwise direction of FIG. 2) of the photosensitive body 10Y. When the latent image formed on the photosensitive body 10Y is developed, an electric field is formed between the development roller 20Y and the photosensitive body 10Y.

Figure 3:
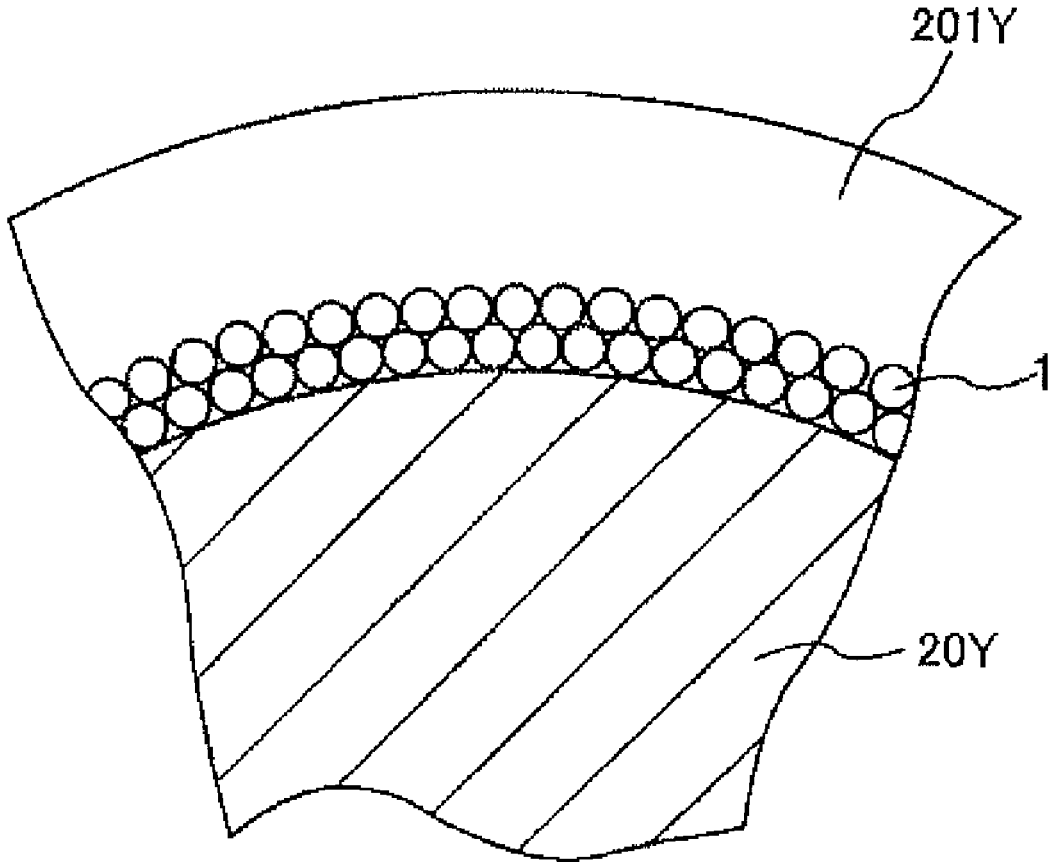
FIG. 3 is a view showing a toner particle state in a liquid developer layer on a development roller.

The corona discharger (compression unit) 23Y has a function for compressing the toner of the liquid developer carried on the development roller 20Y. That is, the corona discharger 23Y applies the electric field having the same polarity as the toner particles 1 to the liquid developer layer 201Y and unevenly distributes the toner particles 1 in the vicinity of the surface of the development roller 20Y in the liquid developer layer 201Y, as shown in FIG. 3. By unevenly distributing the toner particles, it is possible to improve the development concentration (development efficiency) and, as a result, obtain a sharp image with high quality.

In the development unit 10Y, the coating roller 32Y and the development roller 20Y are separately driven by different power sources (not shown). The ratio of the rotation speeds (linear speeds) of the coating roller 32Y and the development roller 20Y is changed such that the amount of liquid developer supplied onto the development roller 20Y can be adjusted.

The development unit 100Y has a development roller cleaning blade 21Y, which is in contact with the surface of the development roller 20Y and is made of rubber, and a developer recovering portion 22Y. The development roller cleaning blade 21Y scrapes and removes the liquid developer remaining on the developer roller 20Y after the development is performed at the above-described development position. The liquid developer removed by the development roller cleaning blade 21Y is recovered into the developer recovering portion 22Y.

As shown in FIGS. 1 and 2, the image forming apparatus 1000 includes liquid developer supply portions 80Y, 80M, 80C and 80K for supplying the liquid developers to the development portions 30Y, 30M, 30C and 30K. The liquid developer supply portions 80Y, 80M, 80C and 80K include liquid developer tanks 81Y, 81M, 81C and 81K, insulating liquid tanks 82Y, 82M, 82C and 82K, and agitation devices 83Y, 83M, 83C and 83K, respectively.

The high-concentration liquid developers of the respective colors are contained in the liquid developer tanks 81Y, 81M, 81C and 81K. The insulating liquids are contained in the insulating liquid tanks 82Y, 82M, 82C and 82K. Predetermined amounts of high-concentration liquid developers from the liquid developer tanks 81Y, 81M, 81C and 81K and predetermined amount of insulating liquids from the insulating liquid tanks 82Y, 82M, 82C and 82K are supplied to the agitation devices 83Y, 83M, 83C and 83K, respectively.

The high-concentration liquid developers and the insulating liquids are agitated by the agitation devices 83Y, 83M, 83C and 83K so as to manufacture the liquid developers of the respective colors, which are respectively used in the liquid developer storage portions 31Y, 31M, 31C and 31K. The liquid developers manufactured by the agitation devices 83Y, 83M, 83C and 83K are supplied to the liquid developer storage portions 31Y, 31M, 31C and 31K, respectively.

As shown in FIGS. 1 and 2, the liquid developers recovered to the developer recovering portions 15Y, 15M, 1SC and 15K and the liquid developers recovered to the developer recovering portions 22Y, 22M, 22C and 22K are recovered to the liquid developer supply portions 80Y, 80M, 80C and 80K, respectively, and are reused. In particular, the liquid developers according to the embodiment of the invention have high redispersibility and thus can be readily reused.

Next, the fixing portion will be described.

The fixing portion F40 fixes the unfixed toner image F5*a* formed on the development portion and the transferring portion on the recording medium F5.

Figure 4:
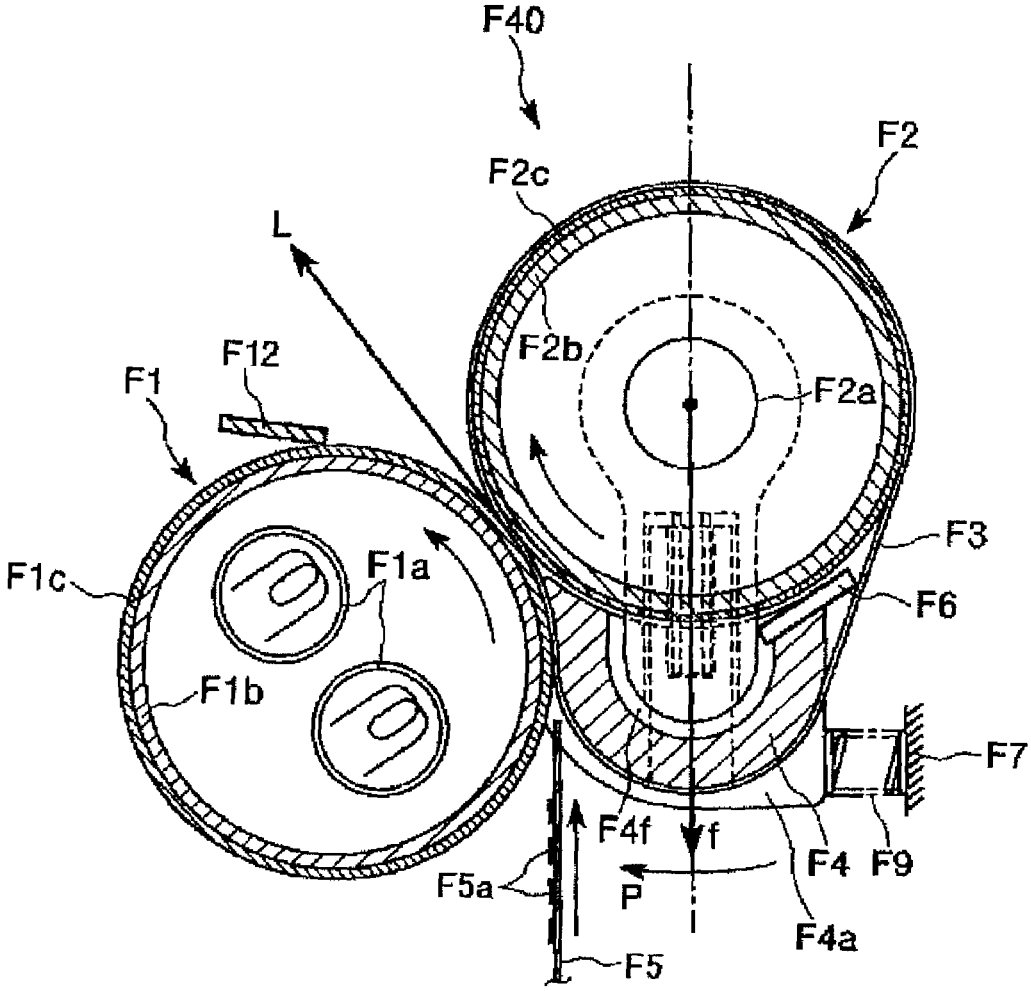
FIG. 4 is a cross-sectional view showing an example of a fixing device applied to the image forming apparatus shown in FIG. 1.

As shown in FIG. 4, the fixing portion F40 includes a thermally fixing roller F1, a pressurization roller F2, a heat-resistant belt F3, a belt stretching member F4, a cleaning member F6, a frame F7, and a spring F9.

The thermally fixing roller (fixing roller) F1 includes a roller base F1*b* configured by a pipe material, an elastic body F1*c* covering the outer circumference of the roller base, and a cylindrical halogen lamp F1*a* in the roller base F1*b* as a heating source, and can rotate in the counterclockwise direction denoted by an arrow of the drawing.

In the thermally fixing roller F1, two cylindrical halogen lamps F1*a* and F1*a* configuring the heating source are mounted and the heating elements of the cylindrical halogen lamps F1*a* and F1*a* are arranged at different positions. By selectively turning on the cylindrical halogen lamps F1*a* and F1*a*, the temperature is readily controlled under different conditions between a fixing nip portion in which the heat-resistant belt F3, which is described below, is wound on the thermally fixing roller F1 and a portion in which the belt stretching member F4 is slidably in contact with the thermally fixing roller F1 or different conditions between a recording medium having a large width and a recording medium having a small width.

The pressurization roller F2 is arranged to face the thermally fixing roller F1 and applies pressure to the recording medium F5 on which the unfixed toner image F5*a* is formed with the heat-resistant belt F3 interposed therebetween.

The pressurization roller F2 has a roller base F2*b* configured by the pipe material and an elastic body F2*c* covering the outer circumference of the roller base and can rotate in the clockwise direction denoted by an arrow of the drawing.

A PFA layer is provided on the surface of the elastic body F1*c* of the thermally fixing roller F1. Accordingly, although the thicknesses of the elastic bodies F1*c* and F2*c* are different, the elastic bodies F1*c* and F2*c* are substantially uniformly elastic-deformed so as to form a horizontal nip. In addition, since the transportation speed of the heat-resistant belt F3 or the recording medium F5 does not become different from the circumferential speed of the thermally fixing roller F1, the image is stably fixed.

The heat-resistant belt F3 is an endless annular belt which is movably stretched over the outer circumferences of the pressurization roller F2 and the belt stretching member F4 and is interposed between the thermally fixing roller F1 and the pressurization roller F2.

The heat-resistant belt F3 has a thickness of 0.03 mm or more and has a front surface (the surface which is in contact with the recording medium F5) formed of PFA and a rear surface (the surface which is in contact with the pressurization roller F2 and the belt stretching member F4) formed of two-layer seamless tube formed of polyimide. The heat-resistant belt F3 is not limited thereto and may be formed of other materials such as a metallic tube such as a stainless tube or a nickel electroformed tube or a heat-resistant resin tube such as silicon.

The belt stretching member F4 is arranged on the upstream side of the transportation direction of the recording medium F5 rather than the fixing nip portion between the thermally fixing roller F1 and the pressurization roller F2, and fluctuates in the direction denoted by an arrow P about the rotation shaft F2*a* of the pressurization roller F2.

The belt stretching member F4 stretches the heat-resistant belt F3 in the tangential direction of the thermally fixing roller F1 in a state in which the recording medium F5 does not passes through the fixing nip portion. If the fixing pressure is high at the initial position where the recording medium F5 introduces into the fixing nip portion, the introduction is not smoothly performed and thus the fixing may be performed in a state in which the front end of the recording medium F5 is folded. However, if the heat-resistant belt F3 is stretched in the tangential direction of the thermally fixing roller F1, an introduction portion of the recording medium F5 for allowing the recording medium F5 to be smoothly introduced can be formed and the stable introduction of the recording medium F5 to the fixing nip portion can be performed.

The belt stretching member F4 is a half-moon-shaped belt sliding member (the heat-resistant belt F3 slides on the belt stretching member F4) which is fitted into the inner circumference of the heat-resistant belt F3 and applies tension f to the heat-resistant belt F3 in cooperation with the pressurization roller F2. The belt stretching member F4 is arranged at a position where the heat-resistant belt F3 is stretched from the tangential line L of the pressing portion between the thermally fixing roller F1 and the pressurization roller F2 to the thermally fixing roller F1 so as to form the nip. A protrusion wall F4*a* protrudes from one end or both ends of the belt stretching member F4 in the axial direction. If the protrusion wall F4*a* reaches one side of the heart-resistant belt F3 in the axial direction, the heat-resistant belt F3 is brought into contact with the protrusion wall F4*a* so as to regulate the reaching to the end of the heat-resistant belt F3. If a spring F9 is mounted between the opposite end of the thermally fixing roller F1 of the protrusion wall F4*a* and the frame, the protrusion wall F4*a* of the belt stretching member F4 is slightly pressed to the thermally fixing roller F1 and the belt stretching member F4 is positioned to be slidably brought into contact with the thermally fixing roller F1.

A position where the belt stretching member F4 is slightly pressed to the thermally fixing roller F1 is a nip start position and a position where the pressurization roller F2 is pressed to the thermally fixing roller F1 is a nip end position.

In the fixing portion F40, when the recording medium F5 on which the unfixed toner image F5*a* is formed is introduced from the nip start position into the fixing nip portion, passes between the heat-resistant belt F3 and the thermally fixing roller F1, and comes out of the nip end position, the unfixed toner image F5*a* formed on the recording medium F5 is fixed. Thereafter, the recording medium is ejected in the tangential direction L of the pressing portion of the pressurization roller F2 to the thermally fixing roller F1.

The cleaning member F6 is interposed between the pressurization roller F2 and the belt stretching member F4.

The cleaning member F6 is slidably brought into contact with the inner circumferential surface of the heat-resistant belt F3 and cleans foreign matters or abrasion powder on the inner circumferential surface of the heat-resistant belt F3. By cleaning the foreign matters or abrasion powder, the heat-resistant belt F3 is refreshed and an unstable factor of a friction coefficient is removed. A concave portion F4*f* is provided in the belt stretching member F4 so as to receive the foreign matters or abrasion powder removed from the heat-resistant belt F3.

The fixing portion F40 has a removal blade (removal unit) F12 for removing the insulating liquid attached to (remaining on) the surface of the thermally fixing roller F1 after the toner image F5*a* is fixed to the recording medium F5. The removal blade F12 removes the insulating liquid and, at the same time, removes the toner transferred onto the thermally fixing roller F1 at the time of fixing.

In order to stretch the heat-resistant belt F3 by the pressurization roller F2 and the belt stretching member F4 so as to stably drive the pressurization roller F2, the friction coefficient between the pressurization roller F2 and the heat-resistant belt F3 is set to be larger than that of the belt stretching member F4 and the heat-resistant belt F3. However, the friction coefficient may become unstable due to the permeation of the foreign matters between the heat-resistant belt F3 and the pressurization roller F2 or between the heat-resistant belt F3 and the belt stretching member F4 and the abrasion of the contact portion between the heat-resistant belt F3 and the pressurization roller F2 or the belt stretching member F4.

Accordingly, the winding angle between the belt stretching member F4 and the heat-resistant belt F3 is set to be smaller than that between the pressurization roller F2 and the heat-resistant belt F3 and the diameter of the belt stretching member F4 is set to be smaller than that of the pressurization roller F2. Accordingly, the length of the heat-resistant belt F3 which slides on the belt stretching member F4 shortens, the unstable factor such as a variation with time or disturbance can be avoided and thus the heat-resistant belt F3 can be stably driven by the pressurization roller F2.

The heat (fixing temperature) added by the thermally fixing roller F1 is preferably 80 to 160° C., more preferably 100 to 150° C., and most preferably 100 to 140° C.

Although the embodiments of the invention are described, the invention is not limited to the embodiments.

For example, the liquid developer of the invention is not limited to the application to the above-described image forming apparatus.

The liquid developer of the invention is not limited to the liquid developer manufactured by the above-described manufactured method.

Although the aqueous emulsified liquid is obtained and the electrolyte is added to the aqueous emulsified liquid so as to obtain the compounded particles in the above-described embodiments, the invention is not limited thereto. For example, the compounded particles may be manufactured using an emulsion polymerization compounding method of dispersing a coloring agent, a monomer, a surfactant, or a polymerization initiator in an aqueous liquid, manufacturing an aqueous emulsified liquid by emulsion polymerization, and adding and compounding an electrolyte to the aqueous emulsified liquid or the compounded particles may be obtained by spraying and drying the obtained aqueous emulsified liquid.

EXAMPLES

1. Synthesis of Resin

Straight Chain Type Polyester Resin PES1

The raw materials having the following compositions such as acid, alcohol component and catalyst were contained in a 50-liter reaction vessel and reaction was performed for 12 hours at 210° C. in a nitrogen atmosphere under the normal pressure. Thereafter, sequential depressurization was performed and reaction was continuously performed with 10 mmHg. The reaction was tracked by the softening temperature on the basis of ASTM E28-517 and was finished at a time point when the softening temperature reached 95° C.

| | |
|---|---|
| terephthalic acid | 79.7 parts by weight |
| isophthalic acid | 53.1 parts by weight |
| ethylene glycol | 28.6 parts by weight |
| neopentyl glycol | 48.0 parts by weight |
| tetrabutyl titanate | 1.0 part by weight |

The obtained polymer (PES1) was an achromic solid, the acid value was 10 mgKOH/g, the glass transition point (Tg) was 55° C. and the softening temperature (T1/2) was 107° C.

The weight-average molecular weight was measured by a GPC measurement device (HLC-8120 GPC manufactured by Tosoh Corporation) using a combination of TSK-GEL G5000HXL.G4000HXL.G3000HXL.G2000HXL manufactured by Tosoh Corporation as a separation column at a column temperature of 40° C., 0.5 mass % of a tetrahydrofuran solvent as a solvent, a filter of 0.2 μm and a flow rate 1 ml/min and was converted using standard polystyrene. At this time, the weight-average molecular weight was 7740.

Straight Chain Type Polyester Resin PES2

The raw materials having the following compositions such as acid, alcohol component and catalyst were contained in a 50-liter reaction vessel and reaction was performed for 11 hours at 210° C. in a nitrogen atmosphere under the normal pressure. Thereafter, sequential depressurization was performed and reaction was continuously performed with 10 mmHg. The reaction was tracked by the softening temperature on the basis of ASTM E28-517 and was finished at a time point when the softening temperature reached 87° C.

| | |
|---|---|
| terephthalic acid | 53.1 parts by weight |
| isophthalic acid | 79.7 parts by weight |
| ethylene glycol | 26.0 parts by weight |
| neopentyl glycol | 43.7 parts by weight |
| tetrabutyl titanate | 1.0 part by weight |

The obtained polymer (PES2) was an achromic solid, the acid value was 10, the glass transition point (Tg) was 46° C. and the softening temperature (T1/2) was 95° C. In addition, weight-average molecular weight was 5200.

Branched Type Polyester Resin PES3

The raw materials having the following compositions such as acid, alcohol component and catalyst were contained in a 50-liter reaction vessel and reaction was performed for 12 hours at 240° C. in a nitrogen atmosphere under the normal pressure. Thereafter, sequential depressurization was performed and reaction was continuously performed with 10 mmHg. The reaction was tracked by the softening temperature on the basis of ASTM E28-517 and was finished at a time point when the softening temperature reached 159° C.

| | |
|---|---|
| terephthalic acid | 19.4 parts by weight |
| isophthalic acid | 90.7 parts by weight |
| adipic acid | 17.1 parts by weight |
| ethylene glycol | 25.4 parts by weight |
| neopentyl glycol | 42.6 parts by weight |
| tetrabutyl titanate | 1.0 part by weight |
| EPICRON 830 (bisphenol F type epoxy resin epoxy equivalent amount 170 (g/eq) manufactured by Dainippon Ink & Chemical Inc.) | 3.0 parts by weight |
| Kadula E (alkyl glycidyl ester manufactured by Shell in Japan) epoxy equivalent amount 250 (g/eq) | 1.0 part by weight |

The obtained polymer (PES3) was an achromic solid, the acid value was 9.8, the glass transition point (Tg) was 40° C. and the softening temperature (T1/2) was 176° C. In addition, weight-average molecular weight was 176000.

2. Manufacture of Liquid Developer

Example 1

First, the toner particles were manufactured. The process in which the temperature is not described was performed at a room temperature (25° C.).

Dispersion Liquid Manufacturing Process

Manufacture of Coloring Agent Master Solution

First, a mixture of the polyester resin PES1 and a cyan pigment (pigment blue of 15:3 manufactured by Dainichiseika Color & Chemicals Mfg. Co. Ltd.) as the coloring agent (mass ratio of 50:50) was prepared. These components were mixed using a 20L-type Henschel mixer and the raw material for manufacturing the toner was obtained.

Next, the raw material (mixture) was kneaded using a double-screw kneading extruder. The kneaded material extruded from the extruding port of the double-screw kneading extruder was cooled.

The cooled kneaded material was coarsely pulverized to obtain powder having an average diameter of 1.0 mm or less. A hammer mill was used for coarsely pulverizing the kneaded material.

Methyl ethyl ketone was added to the obtained powder of the kneaded material such that the content of the solid content becomes 30 wt %. Subsequently, wet dispersion was performed by an Eiger motor mill (M-1000 manufactured by Eiger Corporation of United States) and the coloring agent master solution was manufactured.

Resin Liquid Manufacturing Process 42.6 parts by weight of methyl ethyl ketone and 124.3 parts by weight of the polyester resin and 1.1 parts by weight of Neogen SC-F (manufactured by DAIICHI KOGYO CO., LTD.) as the emulsifying agent was added to 132 parts by weight of the coloring agent master solution and they were mixed by a high-speed disperser (T. K. Robomics/T. K. Homo Disper-2.5 type blade manufactured by Primix Corporation) so as to manufacture the resin liquid. In this liquid, the pigment is uniformly dispersed.

(Dispersoid Forming Process)

Subsequently, 50 parts by weight of 1 normal ammonia water was added to the resin liquid in the vessel, the agitation was sufficiently performed by the high-speed disperser (T. K. Robomics/T. K. Homo Disper-2.5 type blade manufactured by Primix Corporation) in the state in which the speed of the front end of the agitation blade is 7.5 m/s, the temperature of the solution in the flask was adjusted to 25° C., the agitation was performed in the state in which the speed of the front end of the agitation blade is 14.7 m/s, and 170 parts by weight of deionized water was dropped so as to perform phase inversion and emulsification. While the agitation is continuously performed, 70 parts by weight of deionized water was added to the resin liquid. Accordingly, the aqueous dispersion liquid in which the dispersoid including the resin material is dispersed was obtained.

Compounding Process

Next, the aqueous dispersion liquid was moved to the agitation vessel having the Max blend blade, the agitation was performed in the state in which the speed of the front end of the agitation blade is 1.0 m/s, and the temperature of the aqueous dispersion liquid was set to 25° C.

Next, 3.00 parts by weight of 5.0%-aqueous ammonium sulfate solution was dropped while the same temperature and agitation conditions are maintained, the dispersoid was compounded and the compounded particles were formed. After dropping, the agitation was continuously performed until the 50%-volume particle diameter Dv (50) [μm] of the tonerparticles of the compounded particles is grown to 3 μm. If the Dv (50) of the compounded particles becomes 2.5 μm, 120.6 parts by weight of deionized water was added and the compounding was finished.

Solvent Removing Process

The organic solvent was distilled and removed from the obtained dispersion liquid of the compounded particles until the content of the solid content becomes 23 wt % and a slurry of the resin fine particles was obtained.

Cleaning Process

Next, the solid-liquid separation was performed with respect to the slurry and redispersion into water (reslurry) and the solid-liquid separation were repeatedly performed so as to perform the cleaning process. Thereafter, a wet cake of the coloring resin fine particles (resin fine particle cake) was obtained by a suction filtering method. In addition, the moisture content of the wet cake was 35 wt %.

Drying Process

Thereafter, the toner particles were obtained by drying the obtained wet cake using a vacuum drier.

Dispersing Process 37.5 parts by weight of the toner particles obtained by the above-described method, 1.88 parts by weight of N-oleyl-1, 3-diaminopropane (in Formula (I), R: a propyl group of C3, R': an oleyl group of C18, Product name "DUOMEEN OX" manufactured by Lion Akzo Co., Ltd.), and 60 parts by weight of soyate methyl (manufactured by The Nisshin OilliO Group, Ltd.) were contained in a ceramic pot (internal volume of 600 ml), a zirconia ball (ball diameter of 1 mm) was contained in the ceramic pot such that a volume charging ratio becomes 85%, and the dispersion was performed by a desk pot mill for 24 hours at a rotation speed of 230 rpm.

Thereafter, 90 parts by weight of colza oil (product name "high-oleic colza oil", manufactured by The Nisshin OilliO Group, Ltd.) was added and, subsequently, the dispersion was performed by the desk pot mill for 24 hours at a rotation speed of 230 rpm. Accordingly, the liquid developer was obtained.

In the obtained liquid developer, the Dv (50) of the toner particles was 1.85 μm. The 50%-volume particle diameter Dv (50) [μm] of the obtained toner particles was measured by a Mastersizer 2000 particle analysis device (manufactured by Malvern Instruments Ltd.). The particle size was similarly measured with respect to the particles of the following examples and comparative examples.

The viscosity of the obtained liquid developer at 25° C. was 145 mPa·s.

Except that the magenta pigment: pigment red 122, the yellow pigment: pigment yellow 180, and the black pigment: carbon black (Printex L manufactured by Degussa AG) are used instead of the cyan pigment, the magenta liquid developer, the yellow liquid developer and the black liquid developer were manufactured by the same method.

Examples 2 to 5

Except that the dispersing agent in which the carbon number of R and the carbon number of R' in Formula (I) have the values shown in Table 1, the liquid developers of the respective colors were manufactured similar to Example 1. R and R' were the straight chain alkylene group and alkyl group, respectively.

Example 6

Except that the synthesized PES2 is used as the polyester resin, the liquid developers of the respective colors were manufactured similar to Example 1.

Example 7

Except that the PES1 and the PES3 are mixed with a weight ratio of 1:4 as the polyester resin, the liquid developers of the respective colors were manufactured similar to Example 1.

Example 8

Except that the PES2 and the PES3 are mixed with a weight ratio of 1:6 as the polyester resin, the liquid developers of the respective colors were manufactured similar to Example 1.

Example 9

Except that epoxy resin (product name "Epicote 1004", manufactured by Japan Epoxy Resins Co., Ltd., the softening temperature is 80.5° C. and the glass transition point is 50° C.), is used instead of the polyester resin, the liquid developers of the respective colors were manufactured similar to Example 1.

Example 10

Except that styrene-acrylate copolymer in which styrene and acrylate butyl ester are copolymerized with a ratio of 4:1 is used instead of the polyester resin (acid value: 6, softening temperature: 116° C., and glass transition point: 61.6° C.), the liquid developers of the respective colors were manufactured similar to Example 1.

Examples 11 and 12

Except that the adding content of the dispersing agent shown in Table 1 is used, the liquid developers of the respective colors were manufactured similar to Example 1.

Comparative Example 1

Except that the dispersing agent expressed by Formula (I) is not added, the liquid developers of the respective colors were manufactured similar to Example 1.

Comparative Examples 2 to 5

Except that the dispersing agent in which the carbon number of R and the carbon number of R' in Formula (I) have the values shown in Table 1, the liquid developers of the respective colors were manufactured similar to Example 1. R and R' were the straight chain alkylene group and alkyl group, respectively.

With respect to the examples and the comparative examples, the composition and the physicality of the liquid developers are shown in Table 1. In Table, the polyester is denoted by PES1, PES2, and PES3 and the epoxy resin is denoted by EP, and the styrene-acrylate copolymer is denoted by ST-AC.

TABLE 1

| | Liquid developer | | | | | | | | | | | |
|---|---|---|---|---|---|---|---|---|---|---|---|---|
| | Toner particle | | | | Dispersing agent | | | Insulating liquid | | | | |
| | Resin material | | | | | | Content in 100 parts by weight of toner particles [pts. wt] | | Content in insulating liquid [wt %] | | Content in insulating liquid [wt %] | |
| | Type | Acid value [mgKOH/g] | Softening temperature [° C.] | Glass transition point [° C.] | Carbon number of R | Carbon number of R' | | type | | type | | Viscosity |
| Example 1 | PES1 | 10 | 107 | 55 | 3 | 18 | 5 | soyate methyl | 40 | colza oil | 60 | 145 |
| Example 2 | PES1 | 10 | 107 | 55 | 3 | 8 | 5 | soyate methyl | 40 | colza oil | 60 | 150 |
| Example 3 | PES1 | 10 | 107 | 55 | 3 | 24 | 5 | soyate methyl | 40 | colza oil | 60 | 147 |
| Example 4 | PES1 | 10 | 107 | 55 | 2 | 17 | 5 | soyate methyl | 40 | colza oil | 60 | 152 |
| Example 5 | PES1 | 10 | 107 | 55 | 6 | 17 | 5 | soyate methyl | 40 | colza oil | 60 | 151 |
| Example 6 | PES2 | 10 | 95 | 46 | 3 | 18 | 5 | soyate methyl | 40 | colza oil | 60 | 146 |
| Example 7 | PES1 + PES3 | 9.8 | 162 | 43 | 3 | 18 | 5 | soyate methyl | 40 | colza oil | 60 | 145 |
| Example 8 | PES2 + PES3 | 9.8 | 160 | 41 | 3 | 18 | 5 | soyate methyl | 40 | colza oil | 60 | 145 |
| Example 9 | EP | — | 80.5 | 50 | 3 | 18 | 5 | soyate methyl | 40 | colza oil | 60 | 148 |
| Example 10 | ST-AC | 6 | 116 | 61.6 | 3 | 18 | 5 | soyate methyl | 40 | colza oil | 60 | 143 |
| Example 11 | PES1 | 10 | 107 | 55 | 3 | 18 | 1 | soyate methyl | 40 | colza oil | 60 | 156 |
| Example 12 | PES1 | 10 | 107 | 55 | 3 | 18 | 10 | soyate methyl | 40 | colza oil | 60 | 148 |
| Comparative example 1 | PES1 | 10 | 107 | 55 | — | — | — | soyate methyl | 40 | colza oil | 60 | 151 |
| Comparative example 2 | PES1 | 10 | 107 | 55 | 1 | 17 | 5 | soyate methyl | 40 | colza oil | 60 | 155 |
| Comparative example 3 | PES1 | 10 | 107 | 55 | 8 | 17 | 5 | soyate methyl | 40 | colza oil | 60 | 143 |
| Comparative example 4 | PES1 | 10 | 107 | 55 | 3 | 6 | 5 | soyate methyl | 40 | colza oil | 60 | 148 |
| Comparative example 5 | PES1 | 10 | 107 | 55 | 3 | 26 | 5 | soyate methyl | 40 | colza oil | 60 | 147 |

3. Evaluation

The obtained liquid developers were evaluated.

3.1. Development Efficiency

The liquid developer layers due to the liquid developers obtained in the examples and the comparative examples were formed on the development roller of the image forming apparatus using the image forming apparatus shown in FIGS. 1 and 2. Next, the surface potential of the development roller was set to 300 V, the surface potential of the photosensitive body was uniformly set to 500 V, the photosensitive body was exposed, the charge of the surface of the photosensitive body was attenuated, and the surface potential was set to 50 V. After the liquid development layers pass between the photosensitive body and the development roller, the toner particles on the photosensitive body and the toner particles on the development roller were extracted by tapes. The tapes used for extracting the toner particles were attached to a recording sheet and the concentrations of the toner particles were measured. After the measurement, the concentration of the toner particles extracted from the photosensitive body was divided by the total sum of the concentration of the toner particles extracted from the photosensitive body and the concentration of the toner particles extracted from the development roller, the divided value was multiplied by 100, the multiplied value was obtained as the development efficiency, and the development efficiency was evaluated by the four following processes.

A: The development efficiency is equal to or greater than 90% and the development efficiency is significantly excellent.

B: The development efficiency is equal to or greater than 85% and less than 90% and the development efficiency is excellent.

C: The development efficiency is equal to or greater than 80% and less than 85% and no problem occurs.

D: The development efficiency is less than 80% and the development efficiency is poor.

3.2. Transfer Efficiency

The liquid developer layers due to the liquid developers obtained in the examples and the comparative examples were formed on the photosensitive body of the image forming apparatus using the image forming apparatus shown in FIGS. 1 and 2. Next, after the liquid development layers pass between the photosensitive body and the intermediate transferring portion, the toner particles on the photosensitive body and the toner particles on the intermediate transferring portion were extracted by tapes. The tapes used for extracting the toner particles were attached to a recording sheet and the concentrations of the toner particles were measured. After the measurement, the concentration of the toner particles extracted from the intermediate transferring portion was divided by the total sum of the concentration of the toner particles extracted from the photosensitive body and the concentration of the toner particles extracted from the intermediate transferring portion, the divided value was multiplied by 100, the multiplied value was obtained as the transfer efficiency, and the transfer efficiency was evaluated by the following four processes.

A: The transfer efficiency is equal to or greater than 90% and the transfer efficiency is significantly excellent.

B: The transfer efficiency is equal to or greater than 85% and less than 90% and the transfer efficiency is excellent.

C: The transfer efficiency is equal to or greater than 80% and less than 85% and no problem occurs.

D: The transfer efficiency is less than 80% and the transfer efficiency is poor.

3.3. Charge Characteristics of Positive Charge

With respect to the liquid developers of the examples and the comparative examples, the potential difference was measured using ZC-2000 "laser zeta potential analyzer" manufactured by Microtec Co., Ltd. and was evaluated on the basis of following five references.

The measurement was performed by diluting the liquid developers by a dilute solvent, inserting the liquid developers into a transparent cells having □10 mm, detecting the voltage of 300 V at 9 mm between the electrodes, observing the movement speed of the particles in the cell by a microscope so as to calculate the movement speed, and obtaining the zeta potential from the value.

A: The potential is equal to or greater than +100 mV (very good)

B: The potential is equal to or greater than +85 mV and less than +100 mV (good)

C: The potential is equal to or greater than +70 mV and less than +85 mV (normal)

D: The potential is equal to or greater than +50 mV and less than +70 mV (slightly bad)

E: The potential is less than +50 mV (very bad)

3.4. Dispersion Stability Test 10 mL of the liquid developers obtained in the examples and the comparative examples were inserted into test tubes (diameter: 12 mm, length: 120 mm), the sedimentation depths were measured after a week, and the evaluation was performed on the basis of the following four references.

A: The sedimentation depth is 0 mm.

B: The sedimentation depth is greater than 0 mm and equal to or less than 2 mm.

C: The sedimentation depth is greater than 2 mm and equal to or less than 5 mm.

D: The sedimentation depth is greater than 5 mm.

3.5. High Temperature Preserving Property 6 g of the liquid developers obtained in the examples and the comparative examples are contained in glass sample bottles (20 ml) and the lids were closed. They were preserved for 24 hours under the environment of 55° C. of 30% RH. In the sample bottles, the volume average particle diameter Db before preservation and the volume average diameter Da after preservation were measured by a particle size distribution system (master sizer 3000), a variation ratio (%)=(Db−Da)×100/Db was obtained, and evaluation was performed on the basis of the following four references.

A: The variation ratio was 2% or less.

B: The variation ratio was greater than 2% and equal to or less than 10%.

C: The variation ratio was greater than 10% and equal to or less than 50%.

D: The variation ratio was greater than 50%.

3.6. Fixing Strength

Images having a predetermined pattern due to the liquid developers obtained in the examples and the comparative examples were formed on recording sheets (high-quality sheets LPCPPA4 manufactured by Seiko Epson Corporation) using the image forming apparatus shown in FIGS. 1 and 2. Thereafter, the temperature of the thermally fixing roller was set to 100° C. and the thermal fixing process was performed using the fixing device shown in FIG. 4.

Thereafter, non-offset regions were checked, the images fixed on the recording sheets were scrubbed by an eraser (sand eraser "LION 261-11" manufactured by LION OFFICE PRODUCTS CORP.) two times by a pressing load of 1.2 kgf, the residual ratios of the image concentrations were measured by "X-Rite model 404" manufactured by X-Rite Inc. and evaluation was performed on the basis of the following five references.

A: The residual ratio of the image concentration is equal to or greater than 95% (very good).

B: The residual ratio of the image concentration is equal to or greater than 90% and less than 95% (good).

C: The residual ratio of the image concentration is equal to or greater than 80% and less than 90% (normal).

D: The residual ratio of the image concentration is equal to or greater than 70% and less than 80% (slightly bad).

E: The residual ratio of the image concentration is less than 70% (very bad).

These results are shown in Table 2.

TABLE 2

| | Development efficiency | Transfer efficiency | Charge characteristics of positive charge | Dispersion stability | High temperature preserving property | Fixing strength |
|---|---|---|---|---|---|---|
| Example 1 | A | A | A | A | A | A |
| Example 2 | A | A | A | A | A | A |
| Example 3 | A | A | A | A | A | A |
| Example 4 | A | A | A | A | A | A |
| Example 5 | A | A | A | A | A | A |
| Example 6 | A | A | A | A | A | A |
| Example 7 | A | A | A | A | A | A |
| Example 8 | A | A | A | A | A | A |
| Example 9 | A | A | B | B | B | B |
| Example 10 | A | A | A | B | B | A |
| Example 11 | B | C | B | B | C | A |
| Example 12 | B | B | B | B | B | A |

TABLE 2-continued

| | Development efficiency | Transfer efficiency | Charge characteristics of positive charge | Dispersion stability | High temperature preserving property | Fixing strength |
|---|---|---|---|---|---|---|
| Comparative example 1 | D | D | E | D | D | A |
| Comparative example 2 | C | C | D | C | C | A |
| Comparative example 3 | C | C | B | D | D | A |
| Comparative example 4 | C | C | D | D | D | A |
| Comparative example 5 | D | C | D | D | D | A |

As can be seen from Table 2, the liquid developer of the invention was excellent in the charge characteristics (charge characteristics of the positive charge) and the dispersibility of the toner particles. The liquid developer of the invention was excellent in the development efficiency, the transfer efficiency, the high temperature preserving property, and the fixing strength. In contrast, the liquid developers of the comparative examples cannot obtain satisfactory results.

The entire disclosure of Japanese Patent Application No. 2007-294834, filed Nov. 13, 2007 is expressly incorporated by reference herein.

What is claimed is:

1. A liquid developer comprising:

an insulating liquid;

toner particles constituted by a resin material as a main component; and a dispersing agent expressed by Formula (I):

$$H_2N—R—NH—R' \quad (I)$$

(where, R denotes an alkylene group having a carbon number of 2 to 6 and R' denotes an alkyl group having a carbon number of 8 to 24).

2. The liquid developer according to claim 1, wherein the content of the dispersing agent is 1 to 10 parts by weight with respect to 100 parts by weight of the toner particles.

3. The liquid developer according to claim 1, wherein the insulating liquid includes monoester fatty acid.

4. The liquid developer according to claim 3, wherein the content of the monoester fatty acid in the insulating liquid is 1 to 50 wt %.

5. The liquid developer according to claim 1, wherein the resin material has an ester bond.

6. The liquid developer according to claim 1, wherein the acid value of the resin material is 5 to 20 mgKOH/g.

7. The liquid developer according to claim 1, wherein the liquid developer is manufactured by:

manufacturing a dispersion liquid in which a dispersoid including the resin material is dispersed in an aqueous dispersion medium;

compounding a plurality of dispersoids and obtaining compounded particles;

removing an organic solvent included in the compounded particles and obtaining toner particles; and dispersing the toner particles and the dispersing agent in the insulating liquid.

8. An image forming apparatus comprising:

a plurality of development portions forming single-color images of colors using a plurality of liquid developers having different colors;

an intermediate transferring portion sequentially transferring the plurality of single-color images formed on the plurality of development portions and forming an intermediate transfer image obtained by overlapping the plurality of transferred single-color images;

a secondary transferring portion transferring the intermediate transfer image on a recording medium and forming an unfixed color image on the recording medium; and a fixing portion fixing the unfixed color image on the recording medium, wherein the liquid developer includes:

an insulating liquid;

toner particles constituted by a resin material as a main component; and a dispersing agent expressed by Formula (I):

$$H_2N—R—NH—R' \quad (I)$$

(where, R denotes an alkylene group having a carbon number of 2 to 6 and R' denotes an alkyl group having a carbon number of 8 to 24).

* * * * *